US006283905B1

(12) United States Patent
Singh

(10) Patent No.: US 6,283,905 B1
(45) Date of Patent: Sep. 4, 2001

(54) SYSTEM AND METHOD FOR PRODUCING FOLDED ARTICLES

(75) Inventor: Balbir Singh, Media, PA (US)

(73) Assignee: Ethicon, Somerville, NJ (US)

( * ) Notice: Subject to any disclaimer, the term of this patent is extended or adjusted under 35 U.S.C. 154(b) by 0 days.

(21) Appl. No.: 09/387,032

(22) Filed: Aug. 31, 1999

(51) Int. Cl.[7] ..... B31B 1/32

(52) U.S. Cl. ..... 493/360; 493/231; 493/243; 493/256; 493/359; 493/431; 493/454

(58) Field of Search ..... 493/231, 243, 493/256, 405, 418, 424, 442, 450, 353, 357, 359, 360, 431, 425, 432, 443, 445, 444, 454

(56) References Cited

U.S. PATENT DOCUMENTS

| | | | | |
|---|---|---|---|---|
| 2,165,786 | | 7/1939 | Christman | 493/418 |
| 2,870,840 | | 1/1959 | Kwitek | 82/342 |
| 3,489,406 | | 1/1970 | Nystrand | 270/46 |
| 3,540,723 | * | 11/1970 | Schuenemann et al. | 270/77 |
| 3,640,522 | * | 2/1972 | Oelmann et al. | 493/353 |
| 3,689,061 | | 9/1972 | Nystrand | 493/418 |
| 3,870,292 | | 3/1975 | Bradley | 493/418 |
| 4,163,548 | | 8/1979 | Nystrand | 270/39.07 |
| 4,190,241 | | 2/1980 | Krueger | 270/42 |
| 4,218,052 | | 8/1980 | Norén | 270/71 |
| 4,272,066 | | 6/1981 | Bouda | 493/425 |
| 4,332,582 | * | 6/1982 | Hertrich | 493/424 |
| 4,349,185 | | 9/1982 | Small et al. | 270/42 |
| 4,521,209 | | 6/1985 | DeFresne | 493/418 |
| 4,625,957 | | 12/1986 | DuFresne | 198/419.3 |
| 4,655,739 | | 4/1987 | Pratt et al. | 270/42 |
| 4,778,441 | | 10/1988 | Couturier | 270/39.06 |
| 4,917,665 | | 4/1990 | Couturier | 493/359 |
| 5,057,069 | | 10/1991 | Marion | 493/405 |
| 5,842,964 | | 12/1998 | Huber et al. | 493/434 |
| 5,904,277 | * | 5/1999 | Niedermeyer | 493/416 |

FOREIGN PATENT DOCUMENTS

| | | | | |
|---|---|---|---|---|
| 991668 | * | 6/1976 | (CA) . | |
| 19307 | | 9/1882 | (DE) . | |
| 1256431 | * | 12/1971 | (GB) | B65H/45/16 |

* cited by examiner

*Primary Examiner*—Peter Vo
*Assistant Examiner*—Hemant M. Desai
(74) *Attorney, Agent, or Firm*—Baker Botts L.L.P.

(57) ABSTRACT

A system (10) for producing folded articles includes a cutting station (58) operable to segment a fabric web (42) into a continuous stream of individual web segments (86). The system also includes a rotary folder (96) comprising a plurality of folding rollers (104, 106). The rotary folder (96) rotates about an axis spaced apart from axes of the folding rollers (104, 106). The rotary folder (96) is operable to receive the web segments (86) at a first location and fold the web segments one or more times while rotating from the first location to a second location about the rotary folder (96) axis. The system further includes a transfer station (62) operable to receive the folded web segments (86) from the rotary folder (96) at the second location and deliver the folded web segments (86) to a third location.

25 Claims, 28 Drawing Sheets

110
94
42
80
92
86
B
122
118
90
106
A
116
104
90
86
86
C
102
100
D
180°
102

94
42
80
92
86
B
122
106
118
A
C
86
100
86
116
104
102
D
195°
102

110
94
42
80
92
86
102
C
90
100
B
90
86
86
D
116
104
102
106
270°
A
114
118
86
62

94
42
80
92
86
C
102
100
B
D
116
106
86
86
104
102
285°
86
A
118
62

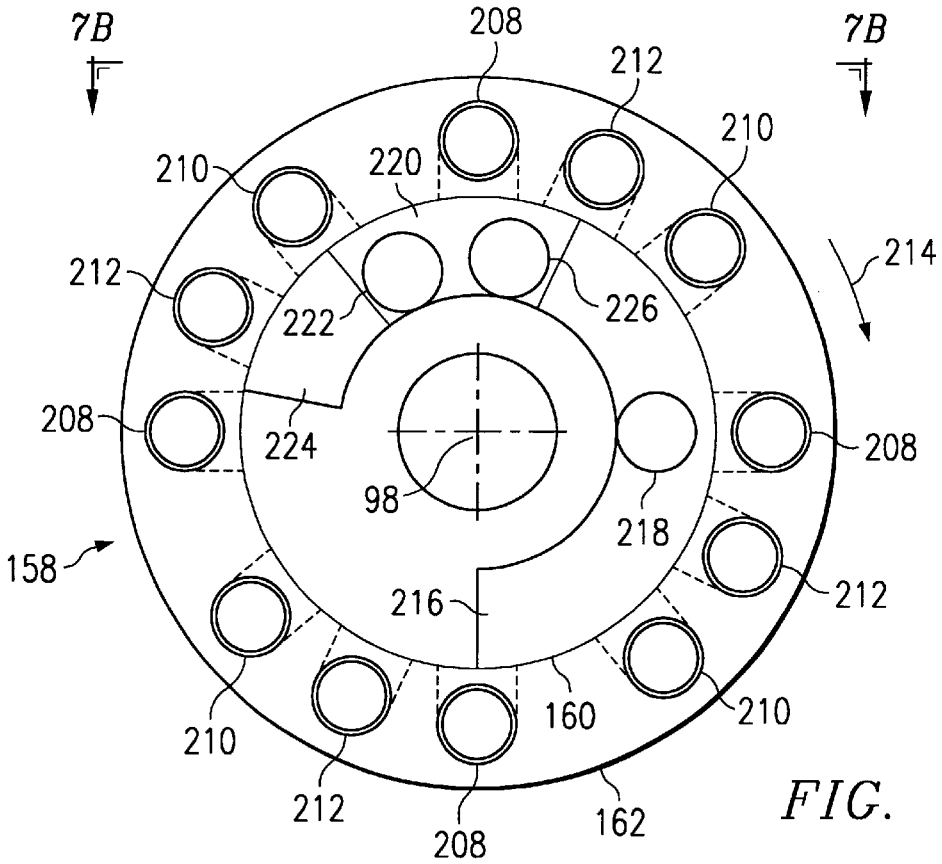
FIG. 7A
FIG. 7B
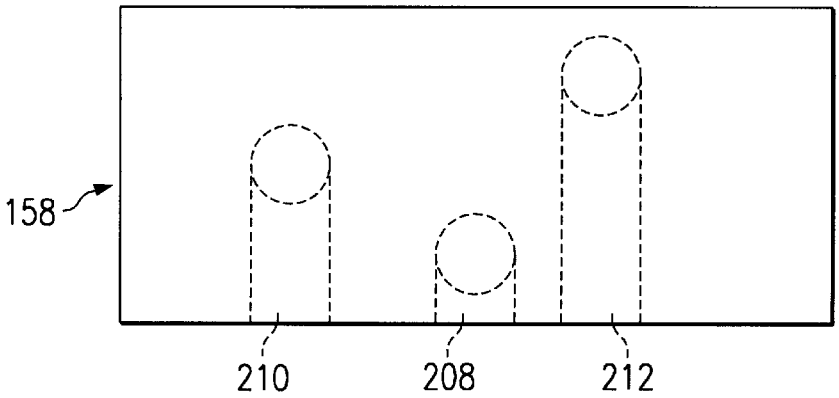

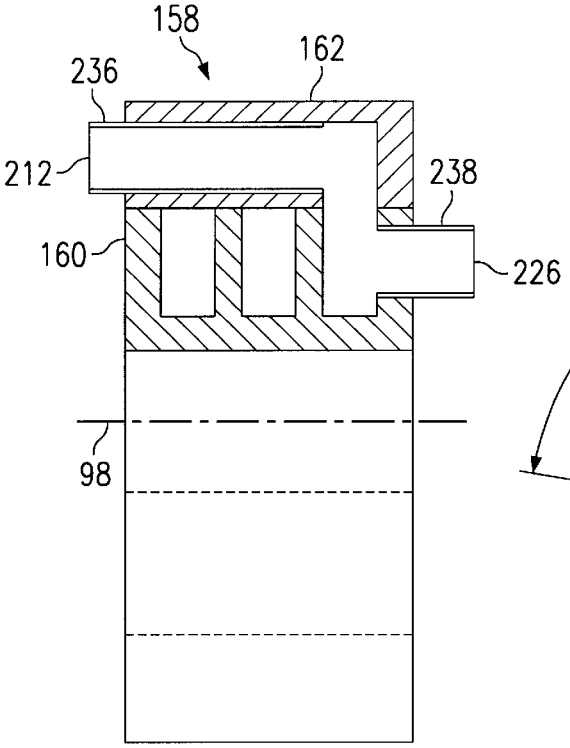
FIG. 7G
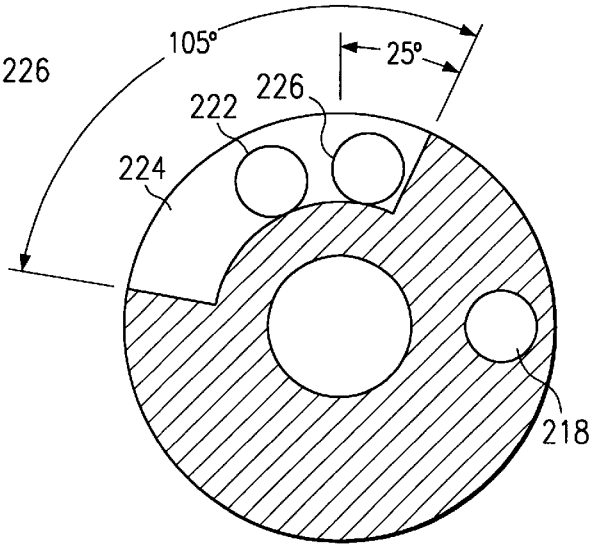
FIG. 7H
FIG. 9A
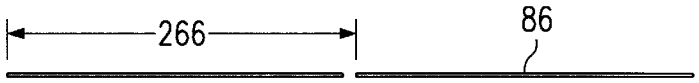
FIG. 9B
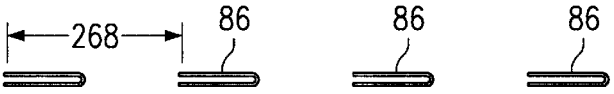
FIG. 9C
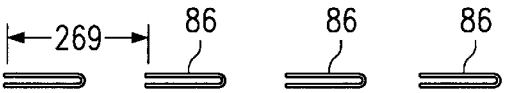

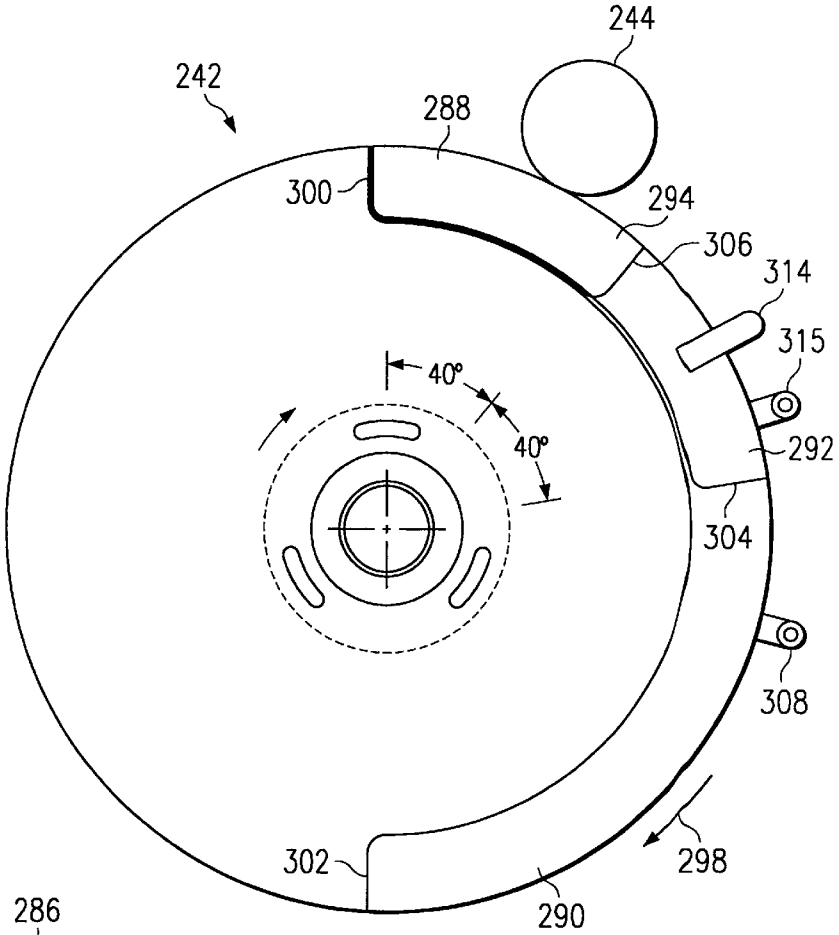
FIG. 10B
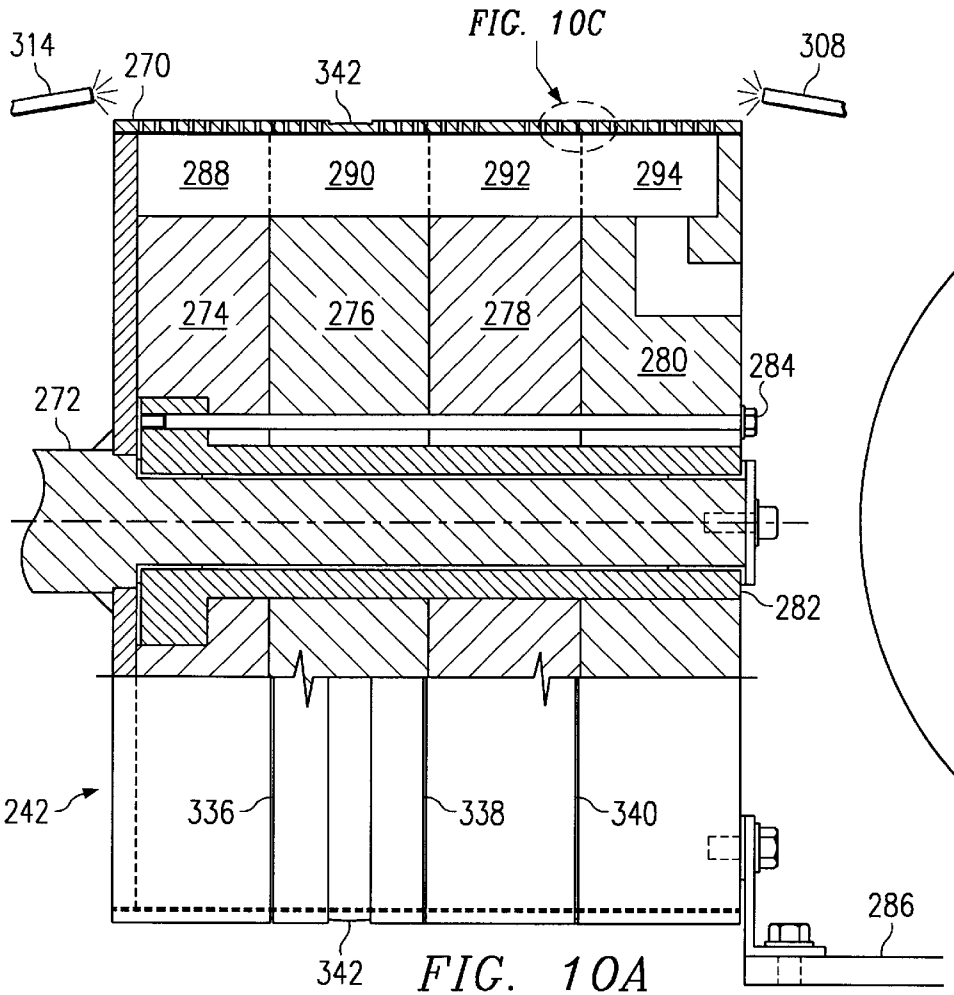
FIG. 10C
FIG. 10A 352
350
354
350
358
356
360
362
350
364
350
366
350

372
370
354
370
374
376
378
380
370
382
370
384
370
386
370

392
390
354
390
394
396
398
400
390
402
390
404
390
406
390

392
390
354
390
394
396
398
400
390
402
390
408
410
390
412
390

SYSTEM AND METHOD FOR PRODUCING FOLDED ARTICLES

TECHNICAL FIELD OF THE INVENTION

The present invention relates generally to the field of fabric or paper converting processes and machinery, and more particularly to a system and method for producing folded articles.

BACKGROUND OF THE INVENTION

Folding systems are generally used for folding and stacking products such as napkins, towels and/or other paper or fabric products. For example, one method for producing a folded product includes longitudinally folding a web by passing the web through or over a plow or similar V-shaped plate. The web is then passed through a series of rollers and transversely cut into discrete segments. Thereafter, through the use of a set of folding rollers, an intermediate portion of the web segment is gripped, generally by vacuum, and drawn between the folding rollers, thereby causing the web to fold on itself transversely. The web segment may also be transferred through additional sets of folding rollers to perform additional transverse folding operations. The web products are thereafter horizontally or vertically stacked with other web products.

To increase efficiency, a double-wide parent roll may also be used to produce two folded web products simultaneously. For example, the double-wide parent roll may be slit longitudinally into web halves and each web half simultaneously processed using a duplicate series of rollers to produce a pair of folded web products. The pair of folded web products may then be superposed and stacked with other superposed pairs of folded web products. The stacks of folded web products may then be delivered into a magazine for subsequent packaging.

Prior fabric folding systems and methods suffer several disadvantages. For example, prior systems generally do not readily accommodate producing a folded web product having a particular length and width from various sizes of web material. Additional folding operations are generally required to reduce the length and/or width of the web material to produce the particular size web product. Thus, additional folding and/or cutting rollers are generally required, thereby increasing the cost, complexity and size of the folding system.

Additionally, prior systems generally require repeated transfer of the web segments between sets of folding rollers to perform additional complex folding operations. For example, the web segments are generally transversely folded using one set of folding rollers and transferred to additional sets of folding rollers to perform additional transverse folding operations. Thus, misfeed of the web segments may result each time the web segment is transferred between sets of folding rollers, especially during high speed folding operations, thereby causing a cessation in system operation.

Further, prior systems do not readily accommodate individual packaging of a web product or pair of web products. For example, prior systems generally produce vertical or horizontal stacks of folded web products. The stacks are then subsequently divided into smaller stacks of a specified count for subsequent handling and packaging.

SUMMARY OF THE INVENTION

Accordingly, a need has arisen for a system and method for producing folded articles that accommodates individual packaging of folded web products and producing a particular size of web products from various sizes of web material. The present invention provides a system and method for producing folded articles that address the shortcomings of prior systems and methods.

According to one embodiment of the present invention, a system for producing folded articles includes a cutting station operable to segment a fabric web into a continuous stream of individual web segments. The system also includes a rotary folder comprising a plurality of folding rollers. The rotary folder rotates about an axis spaced apart from axes of the folding rollers. The rotary folder is operable to receive the web segments at a first location and fold the web segments one or more times while rotating from the first location to a second location about the rotary folder axis. The system also includes a transfer station operable to receive the folded web segments from the rotary folder at the second location and deliver the folded web segments to a third location.

According to another embodiment of the present invention, a method for producing folded articles includes segmenting a fabric web into a continuous stream of individual web segments. The method includes receiving the web segments at a rotary folder. The rotary folder comprises a plurality of folding rollers. The method also includes rotating the folding roller from a first location to a second location about an axis spaced apart from axes of the folding rollers. The system further includes folding the web segments one or more times using the rotary folder as the rotary folder rotates from the first location to the second location.

The technical advantages of the present invention include providing a system for producing folded articles that produces folded articles having a particular length and width from various sizes of web material. For example, according to one aspect of the present invention, a rotary folder is operable to transversely fold the articles one or more times, and a folding drum is operable to receive the articles from the rotary folder and longitudinally fold the articles one or more times.

Additionally, the present invention provides increased folding operations in a generally compact folding station. For example, according to one aspect of the present invention, a rotary folder is operable to receive a web segment at a first location and fold the web segment at least three times during rotation of the rotary folder before delivering the folded web segment to a second location.

Another technical advantage of the present invention includes providing a system for producing folded articles that delivers the folded articles at a predetermined spacing to accommodate individual packaging of the folded articles. For example, according to one aspect of the present invention, a stripper belt decelerates the folded articles to adjust the spacing between successive folded articles. The system then delivers the folded articles at the predetermined spacing to match a packaging registration.

Other technical advantages of the present invention will be readily apparent to one skilled in the art from the following figures, descriptions and claims.

BRIEF DESCRIPTION OF THE DRAWINGS

For a more complete understanding of the present invention and the advantages thereof, references now made to the following description taken in connection with the accompanying drawings in which:

FIGS. 7A–7H are diagrams illustrating a vacuum block for the rotary folder illustrated in FIGS. 5A–5C and 6A–6B in accordance with an embodiment of the present invention;

FIGS. 9A–9C are diagrams illustrating the spacing between successive folded articles in accordance with an embodiment of the present invention are;

DETAILED DESCRIPTION OF THE INVENTION

Embodiments of the present invention and the advantages thereof are best understood by referring to the following descriptions and drawings, wherein like numerals are used for like and corresponding parts of the various drawings.

Figure 1A:
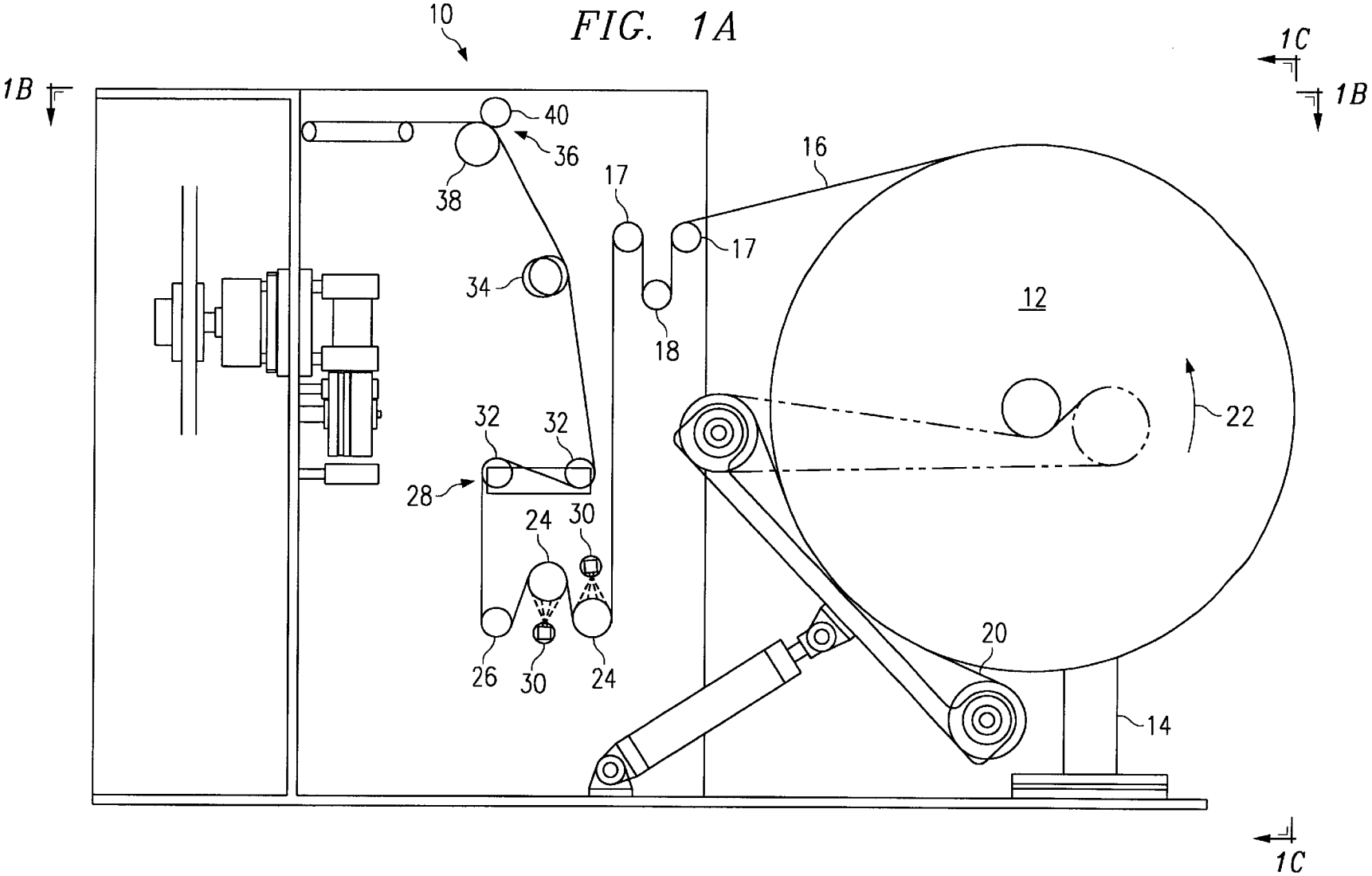
FIGS. 1A–1C are diagrams illustrating a system for producing folded articles in accordance with an embodiment of the present invention.
Figure 1B:
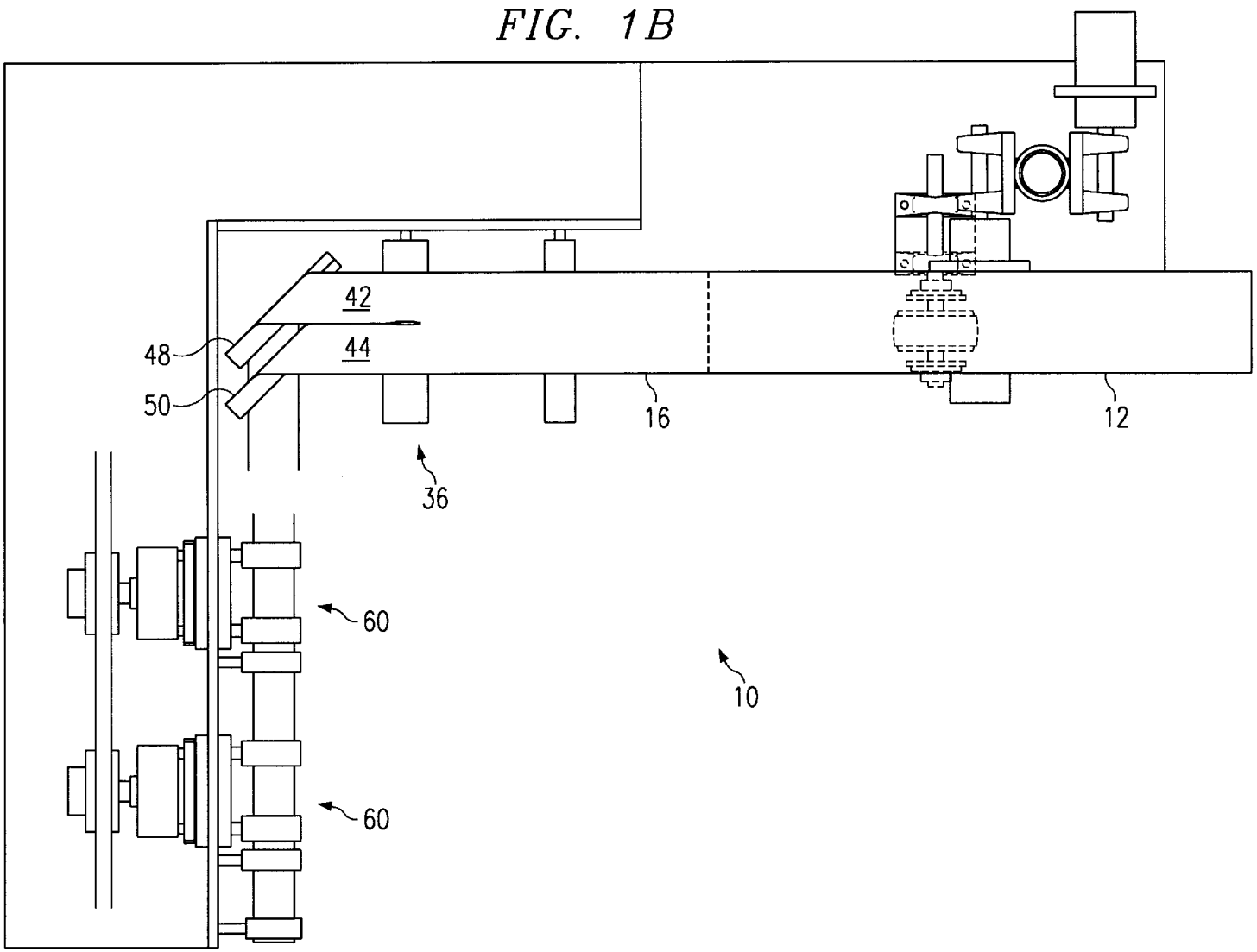
Figure 1C:
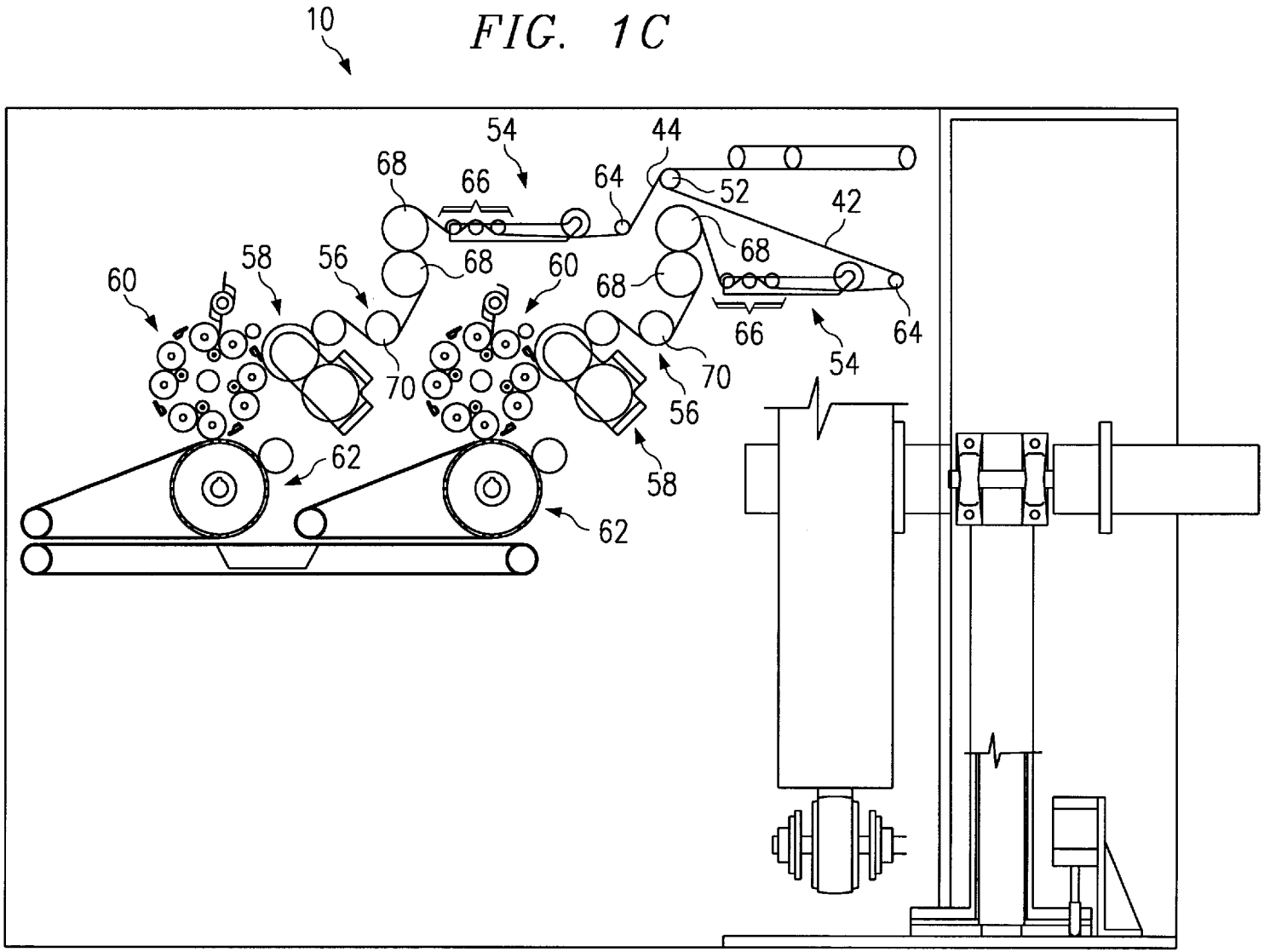

FIGS. 1A–1C are diagrams illustrating a system 10 for producing folded articles in accordance with an embodiment of the present invention. Referring to FIGS. 1A and 1B, system 10 comprises a parent roll 12 of paper or fabric rotatably mounted to an unwind stand 14. Parent roll 12 may comprise paper, woven material, non-woven material, or other suitable materials for producing folded articles. For example, parent roll 12 may include woven or non-woven cotton or rayon/polyester fabric materials.

A primary fabric web 16 from parent roll 12 is fed through detour rollers 17 and a weighted dancer roller 18 positioned downstream of parent roll 12. As used throughout this description, "downstream" relates to the direction of fabric travel through system 10, whereas the term "upstream" refers to a direction opposite that of fabric travel. Dancer roller 18 moves up or down in response to changes in fabric web 16 tension, and using a sensor (not explicitly shown), controls a feed rate of fabric web 16 by modulating a speed of a drive belt 20 as a function of fabric web 16 tension. In operation, fabric web 16 is unwound from parent roll 12 by rotating parent roll 12 in a direction indicated by arrow 22.

Fabric web 16 is fed downstream from detour rollers 17 to draw and calender rollers 24. Draw and calendar rollers 24 rotate with such a speed of rotation that rollers 24 pull fabric web 16 and feed fabric web 16 downstream through a detour roller 26 to an alignment station 28. Fabric web 16 may also receive a moisturizing agent delivered by misters 30 as fabric web 16 passes through draw and calendar rollers 24. Additionally, other fabric treatment process may be performed on fabric web 16, such as, but not limited to, heat calendaring, embossing, and perforating.

Alignment station 28 includes guide rollers 32 to guide fabric web 16 laterally with respect to a longitudinal downstream direction of fabric web 16 in response to edge sensor (not explicitly shown) feedback. In operation, fabric web 16 is fed from alignment station 28 downstream to a spreader roller 34 and cutting station 36. Spreader roller 34 may be used to remove wrinkles in fabric web 16 prior to fabric web 16 reaching cutting station 36. Cutting station 36 includes a driven slitter roller 38 and an anvil roller 40 for separating fabric web 16 into two substantially equal width web streams 42 and 44. Thus, alignment station 28 aligns fabric web 16 so that cutting station 36 provides substantially equally width web streams 42 and 44.

Referring to FIGS. 1B and 1C, web streams 42 and 44 are fed downstream from cutting station 36 over turning bars 48 and 50, respectively. Turning bars 48 and 50 operate to turn web streams 42 and 44, respectively, approximately ninety degrees to position web streams 42 and 44 in above-and-below relation to each other. Web streams 42 and 44 are then fed downstream over detour roller 52 to two identical sets of folding stations 54, tucking stations 56, cutting stations 58, folding stations 60, and transfer stations 62. For ease of illustration, only the progression of web stream 42 through folding station 54, tucking station 56, cutting station 58, folding station 60, and transfer station 62 is described below. It should be understood that web stream 44 follows a similar progression through system 10.

Referring to FIG. 1C, web stream 42 is fed downstream over detour roller 52 and detour roller 64 to folding station 54. Folding station 54 longitudinally folds web stream 42 using folding plows (not explicitly shown) and rollers 66. For example, folding station 54 may be used to fold the longitudinally edges of web stream 42 inwardly so that fiber edges of web stream 42 are disposed inwardly. However, web stream 42 may also be longitudinally folded into other configurations. Web stream 42 is then fed downstream over draw rollers 68 to tucking station 56.

Figure 2A:
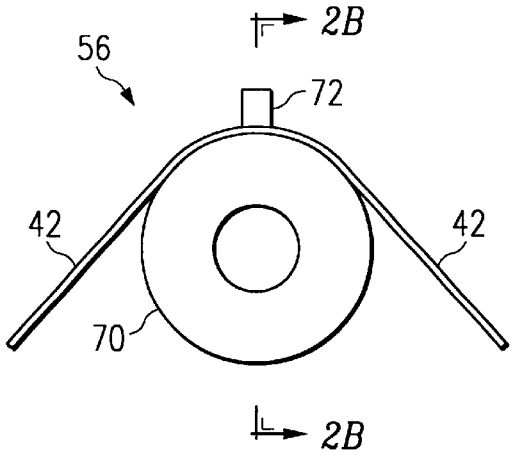
FIGS. 2A–2C are diagrams illustrating a tucking station of the system in accordance with an embodiment of the present invention.
Figure 2B:
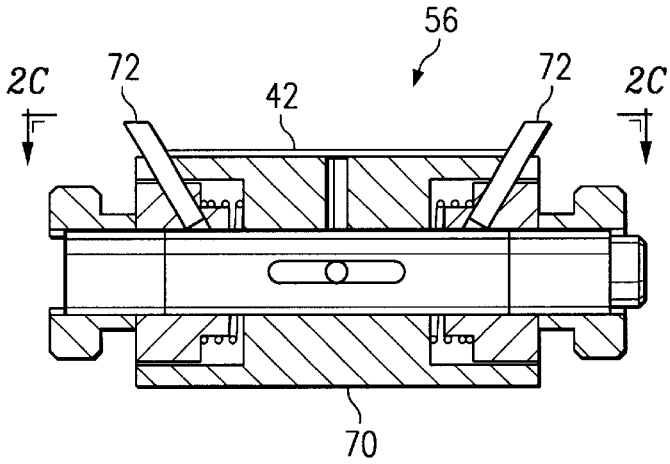
Figure 2C:
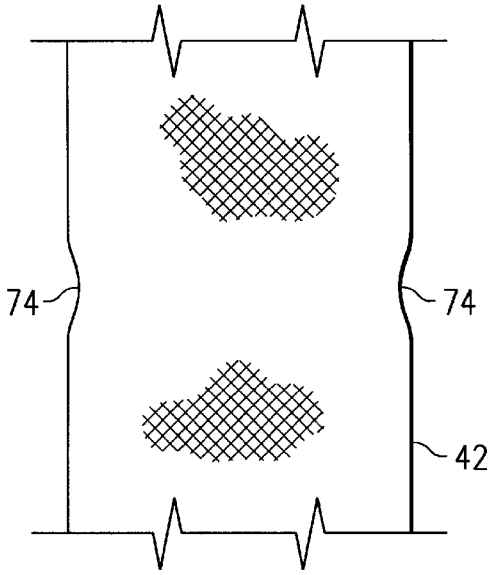

FIGS. 2A–2C are diagrams illustrating tucking station 56 in accordance with an embodiment of the present invention. Tucking station 56 comprises a tucking roller 70 having a plurality of tucking pins 72. Tucking pins 72 are each secured near an end of tucking roller 70 at an outwardly disposed angle such that web stream 42 passing over tucking roller 70 between tucking pins 72. In operation, as tucking roller 70 rotates, tucking pins 72 intermittently contact web stream 42 and cause the longitudinal edges of web stream 42 to slide down tucking pins 72, thereby tucking the edges of web stream 42 inwardly to form tucked portions 74 of web stream 42.

Tucking roller 70 is sized to have a diameter such that the distance between tucked portions 74 of web stream 42 corresponds to locations where web stream 42 will be severed at cutting station 58. Thus, the diameter of tucking roller 70 may be increased to provide a greater distance between tucked portions of web stream 42 and decreased to provide a reduced distance between tucked portions 74 of web stream 42. As illustrated in FIGS. 2B and 2C, the lateral width of web stream 42 is reduced at tucked portions 74 where tucking pins 72 contact web stream 42 to provide more efficient and clean severing of web stream 42 at cutting station 58.

Figure 3:
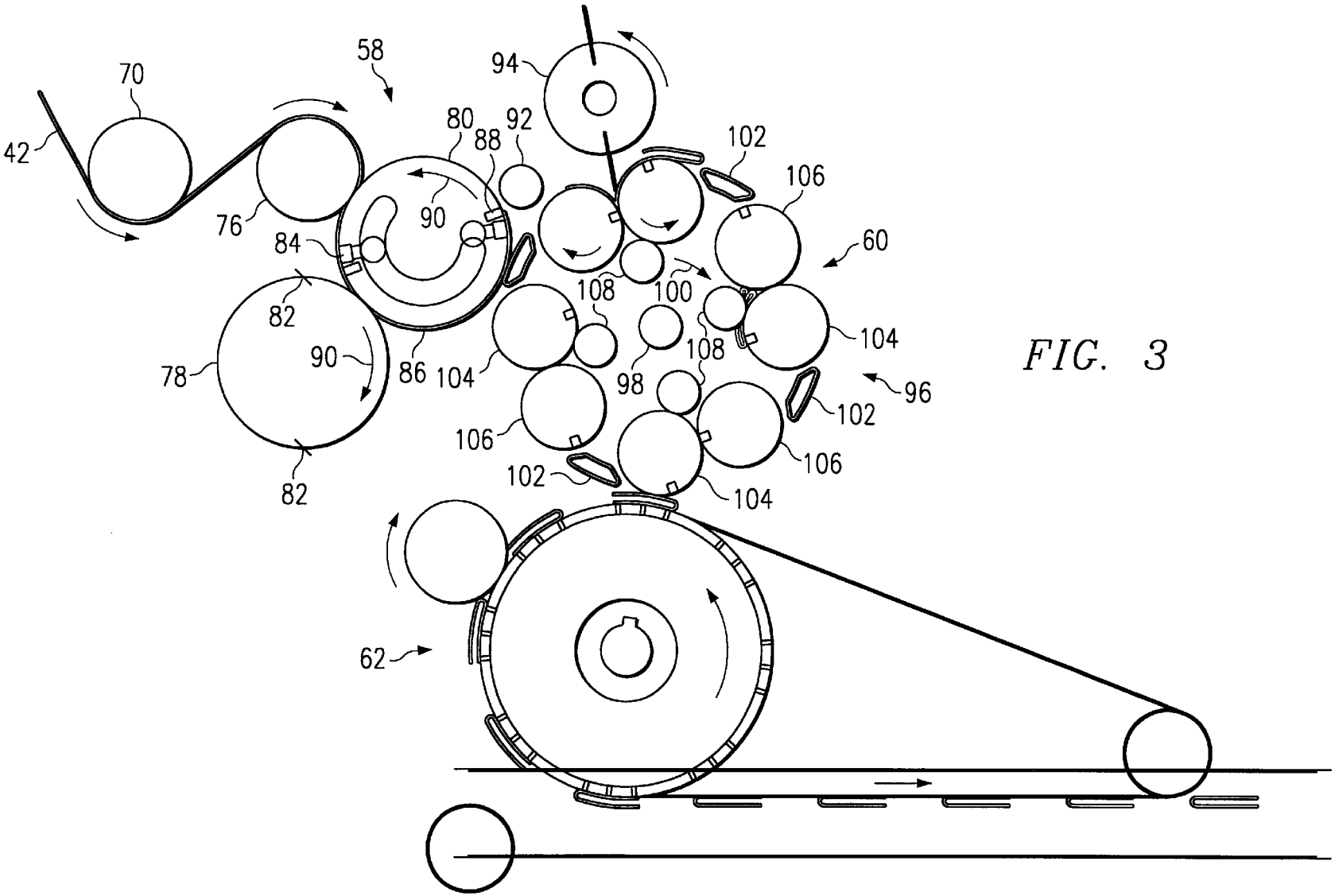
FIG. 3 is a diagram illustrating a cutting station, folding station, and transfer station of the system in accordance with an embodiment of the present invention.

FIG. 3 is a diagram illustrating cutting station 58, folding station 60, and transfer station 62 in accordance with an embodiment of the present invention. Cutting station 58 comprises a rider roller 76, a cutter roller 78, and an anvil roller 80. Cutter roller 78 comprises protruding blades 82 which operate in conjunction with corresponding anvils 84 of anvil roller 80 to transversely segment web stream 42 into a continuous stream of individual web segments 86. Anvil roller 80 comprises axially extending vacuum ports 88 to control the leading edge of each web segment 86. In the embodiment illustrated in FIG. 3, cutter roller 78 comprises two blades 82, and anvil roller 80 comprises two anvils 84 and two vacuum ports 88 for fabricating web segments 86 having a longitudinal length equal to approximately half the circumference of cutter roller 78 and anvil roller 80. However, additional or fewer blades 82, anvils 84, and vacuum ports 88 may be used to produced web segments 86 of varying length.

Thus, in operation, web stream 42 is fed through a nip defined by adjacent rollers 78 and 80 where vacuum port 88 of anvil roller 80 is valved on to retain a leading edge of web stream 42. As cutter roller 78 and anvil roller 80 rotate in a direction indicated by arrows 90, blade 82 of cutter roller 78 operates in conjunction with anvil 84 of anvil roller 80 to transversely segment web stream 42 into individual web segments 86.

Web segments 86 are fed downstream from cutting station 58 over detour roller 92 to folding station 60. Folding station 60 comprises a tucking roller 94 and a rotary folder 96. Rotary folder 96 comprises four sets or stations of members equally spaced in a circular orientation relative to a rotational axis 98 of rotary folder 96. Each station of rotary folder 96 is spaced apart from axis 98 and rotates about axis 98 in the direction indicated by arrow 100. Each station of rotary folder 96 comprises a pick-up shoe 102, folding rollers 104 and 106, and an ironing roller 108. Folding rollers 104 and 106 and ironing roller 108 also rotate about axes independent of axis 98. Thus, folding rollers 104 and 106 and ironing roller 108 each rotate while rotating about axis 98.

Figure 4A:
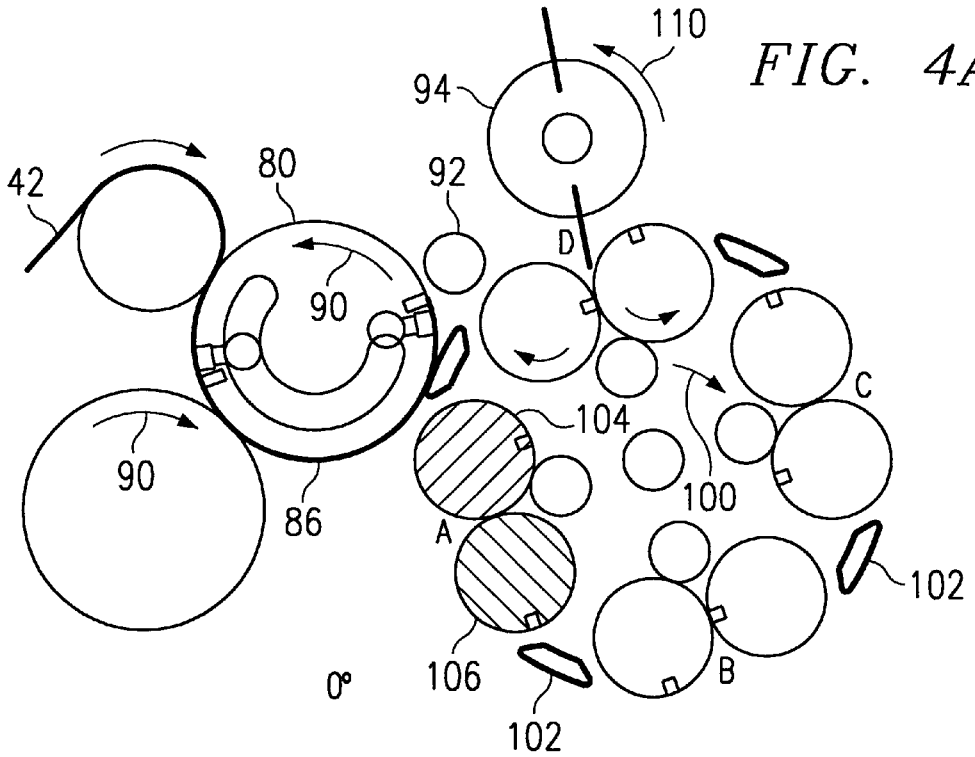
FIGS. 4A–4X are diagrams illustrating a progression of web segments through the system in accordance with an embodiment of the present invention.
Figure 4B:
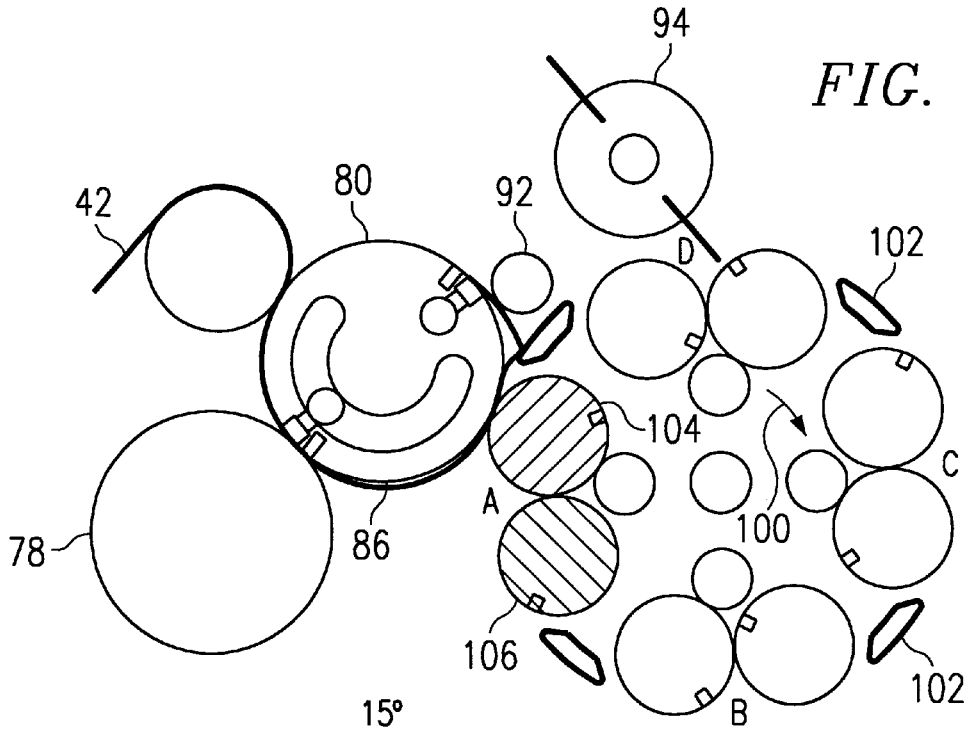
Figure 4C:
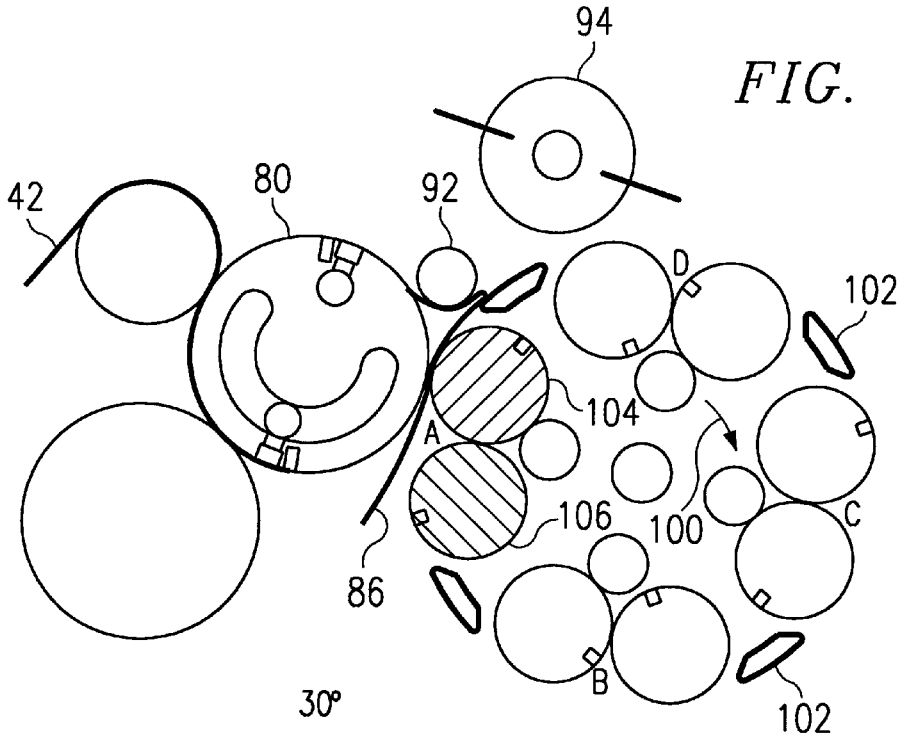
Figure 4D:
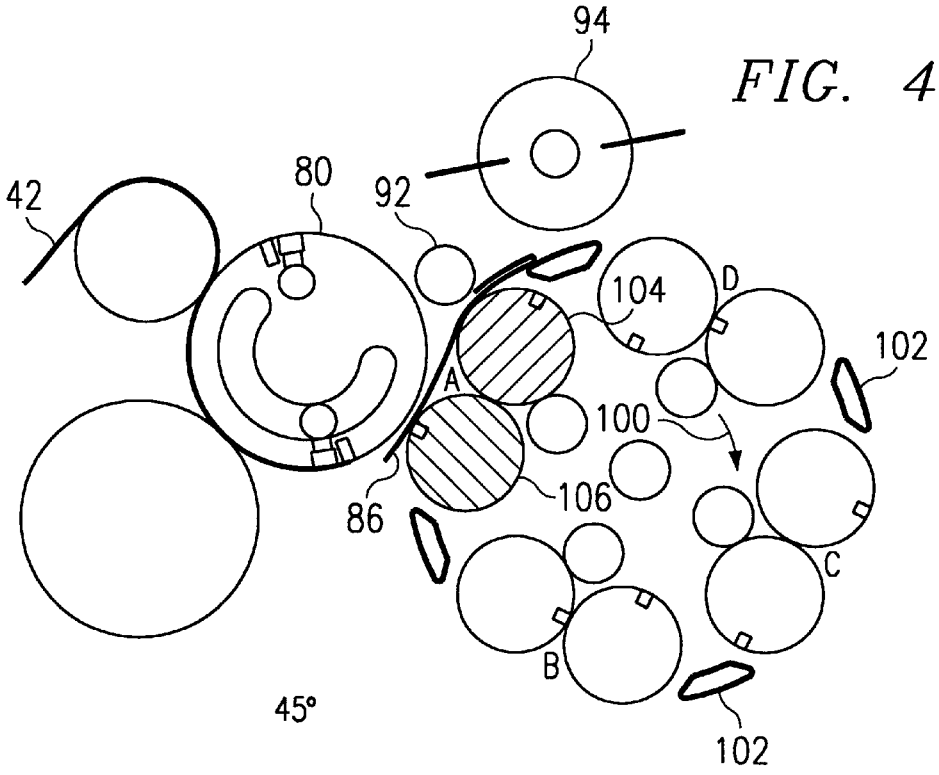
Figure 4E:
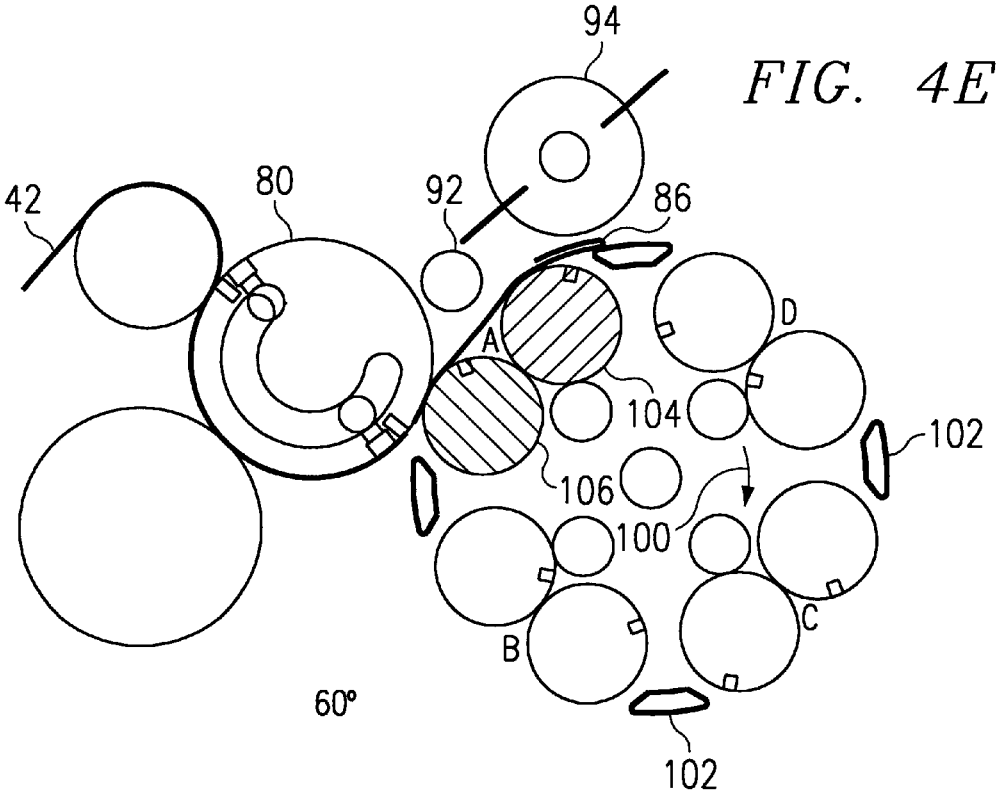
Figure 4F:
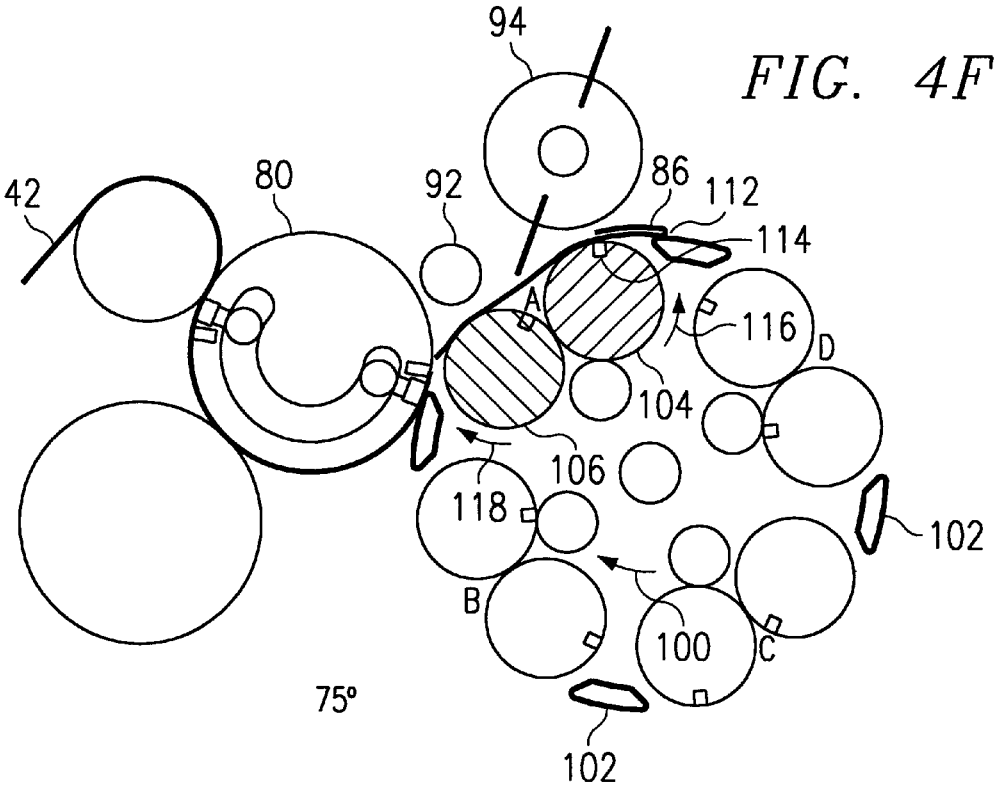
Figure 4G:
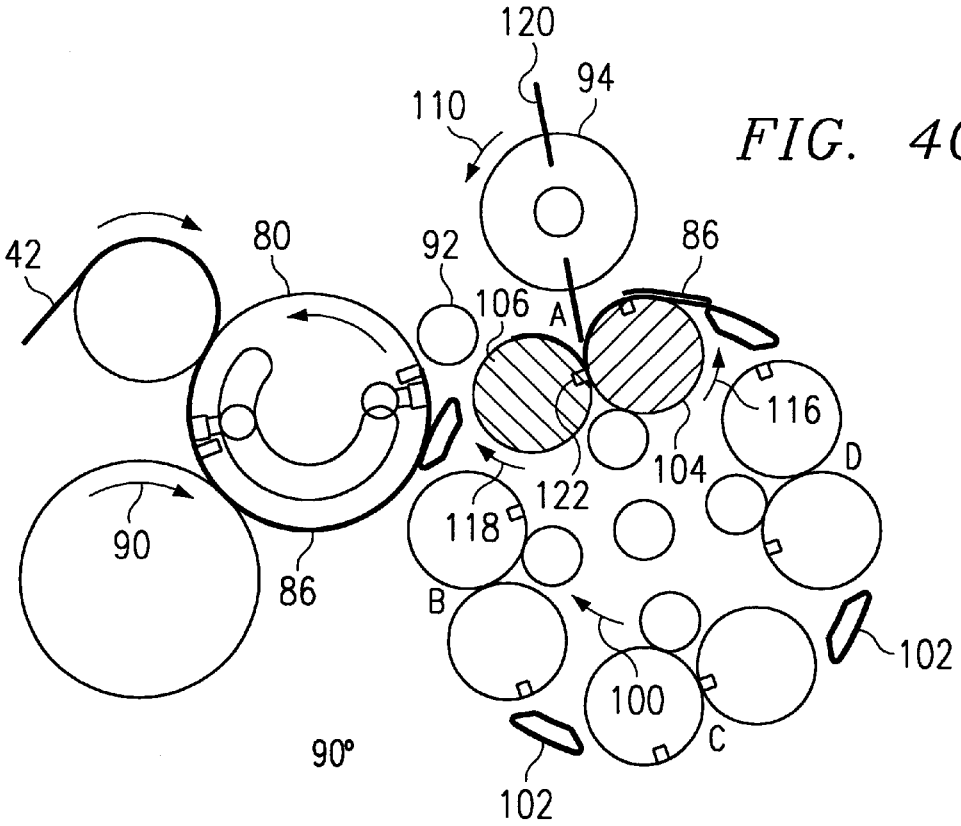
Figure 4H:
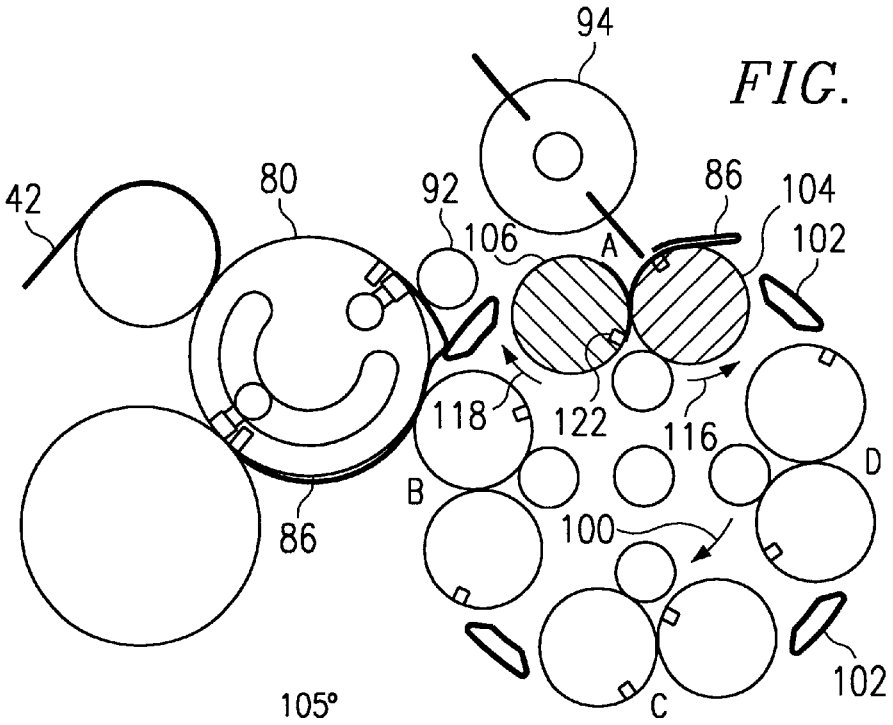
Figure 4I:
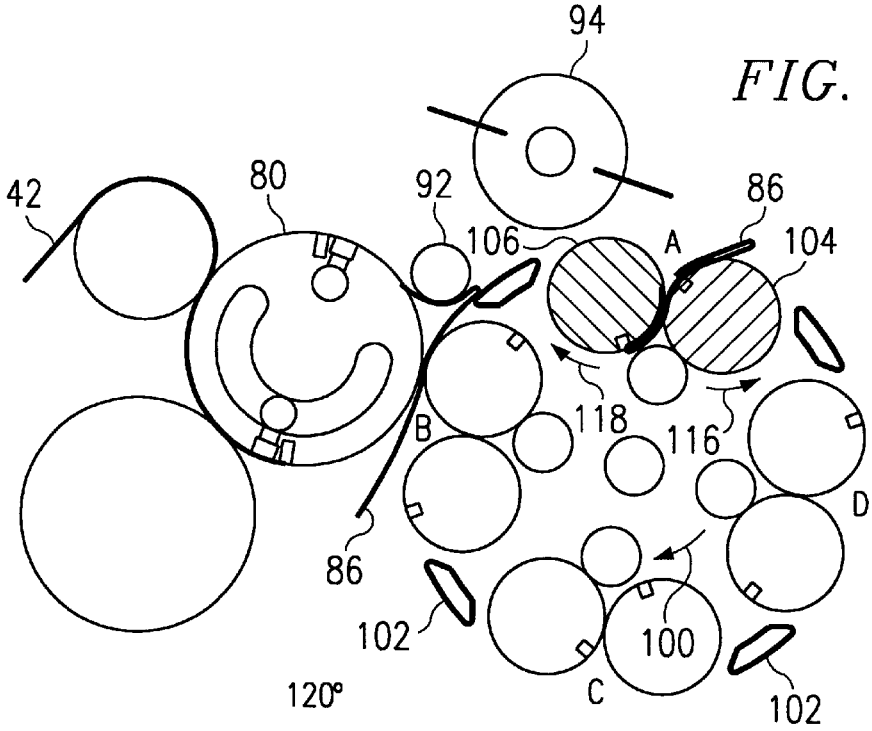
Figure 4J:
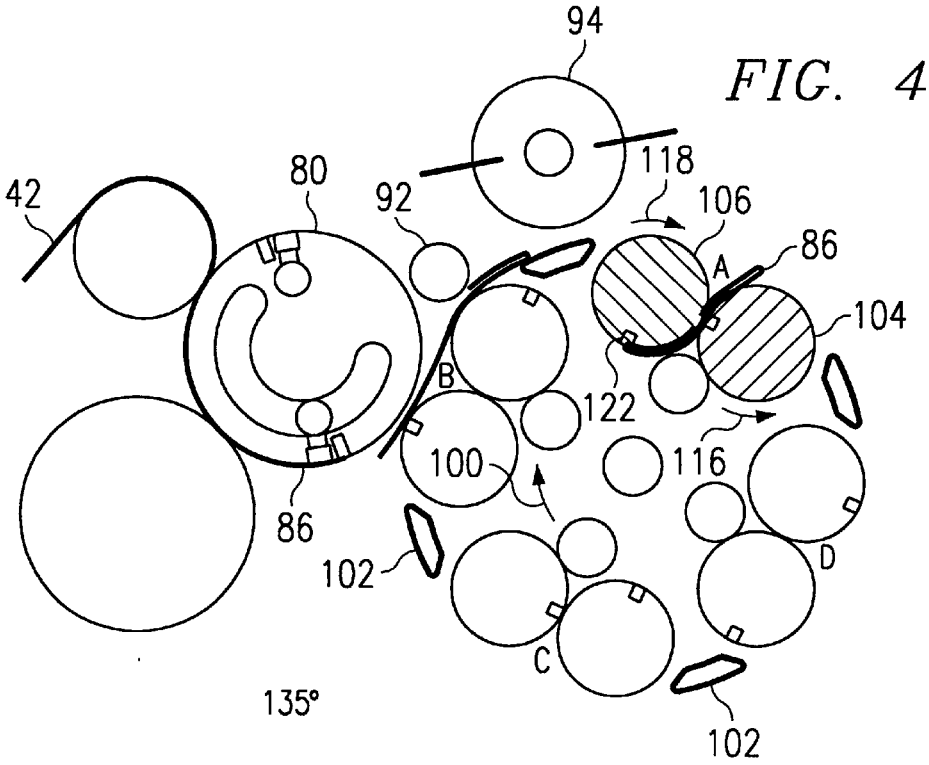
Figure 4K:
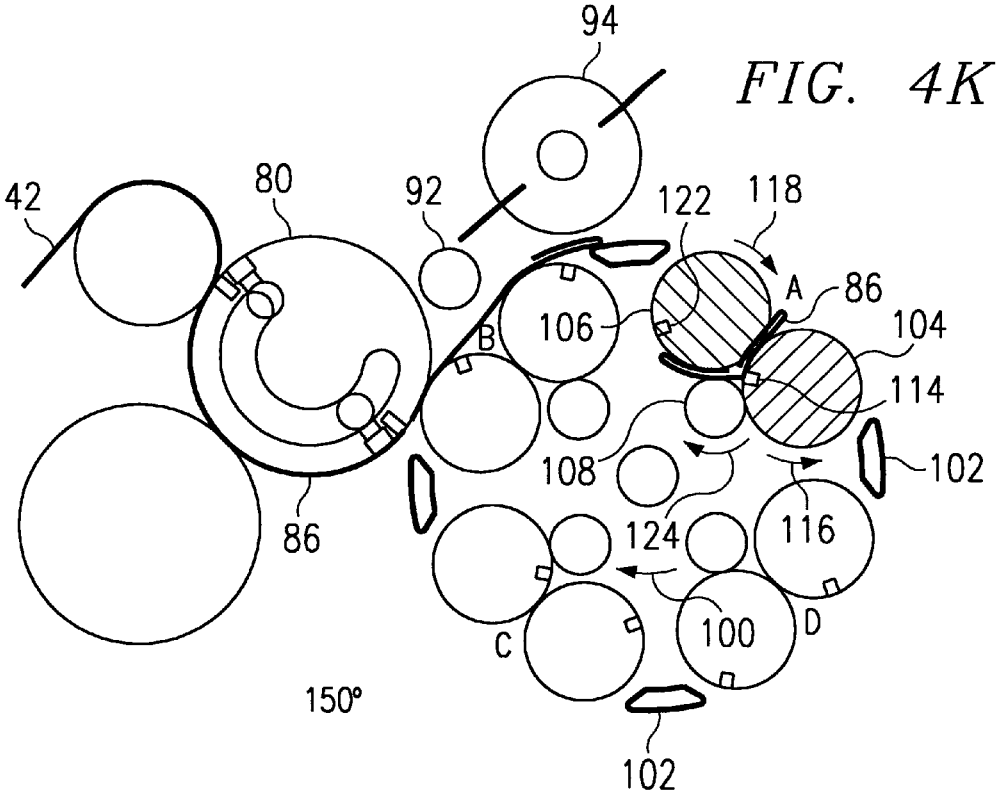
Figure 4L:
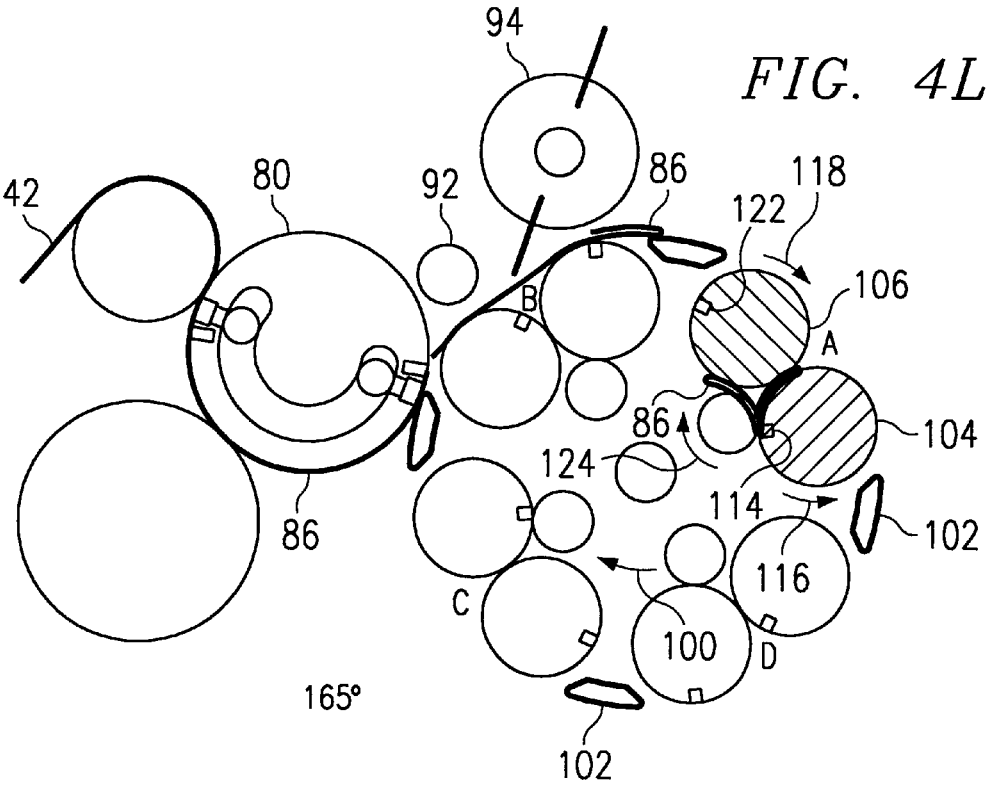
Figure 4M:
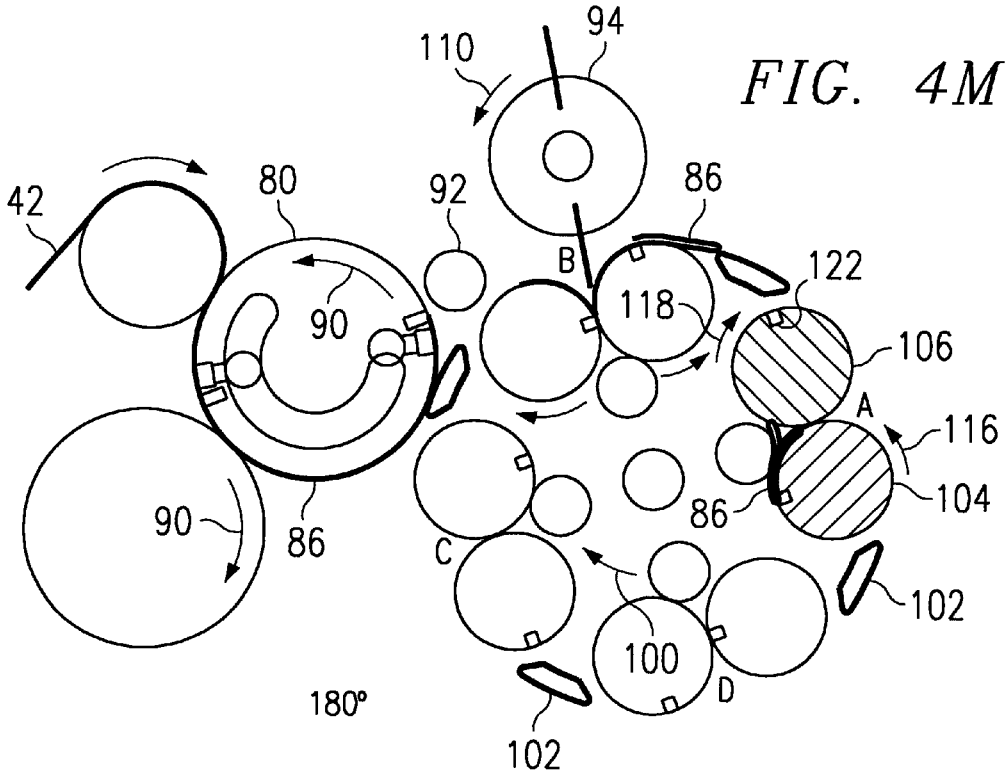
Figure 4N:
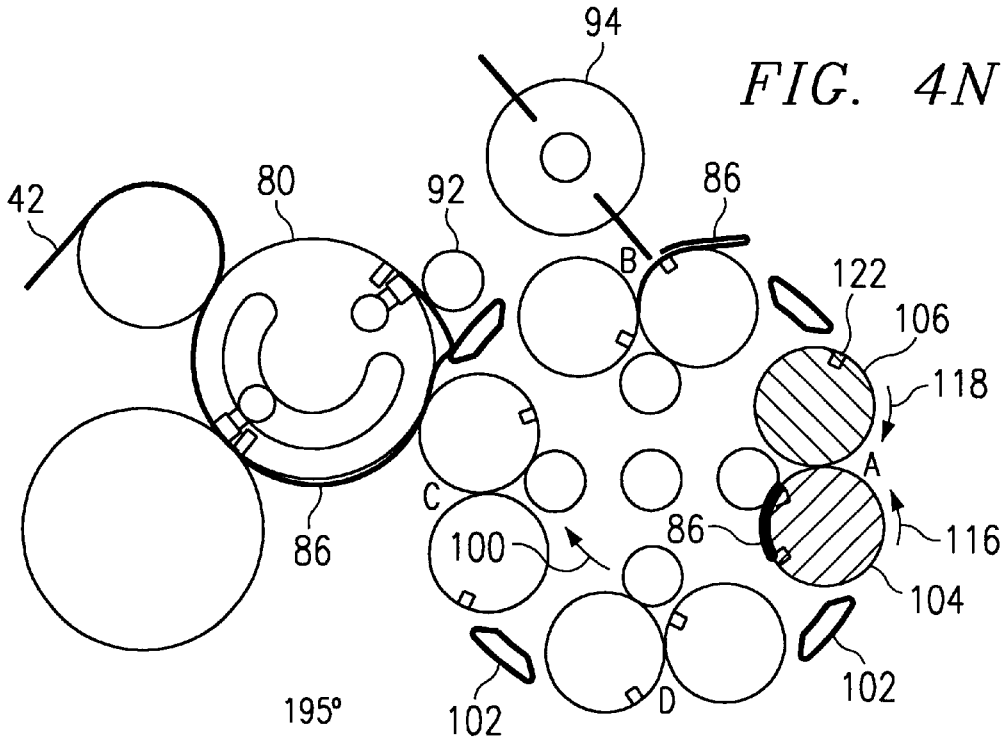
Figure 40:
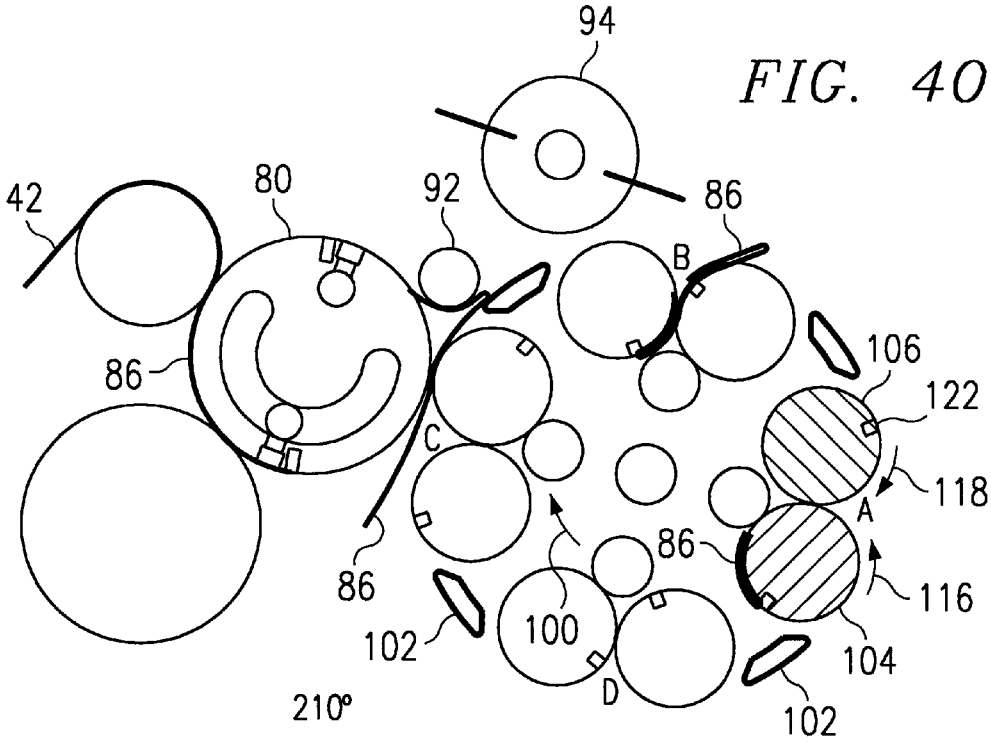
Figure 4P:
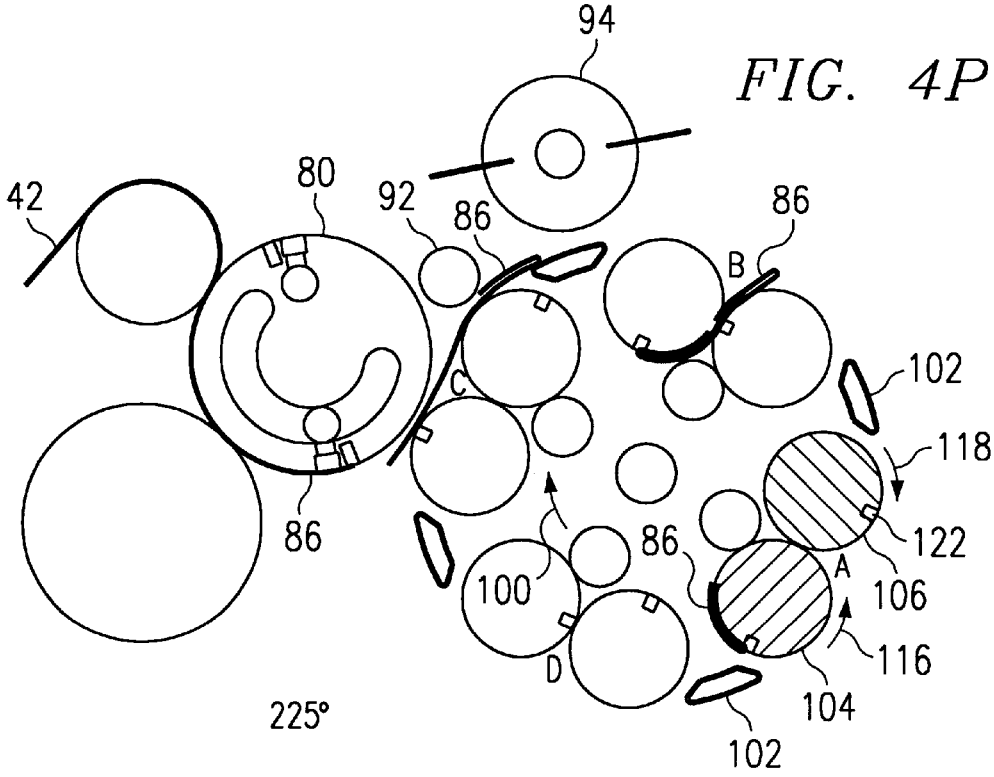
Figure 4Q:
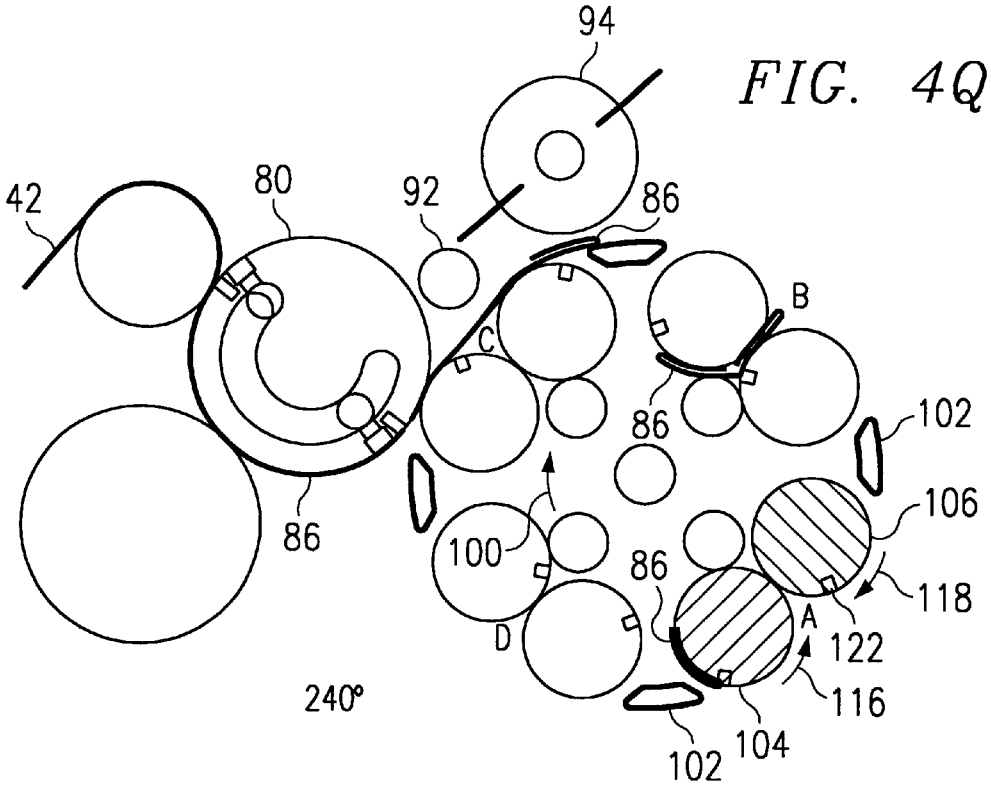
Figure 4R:
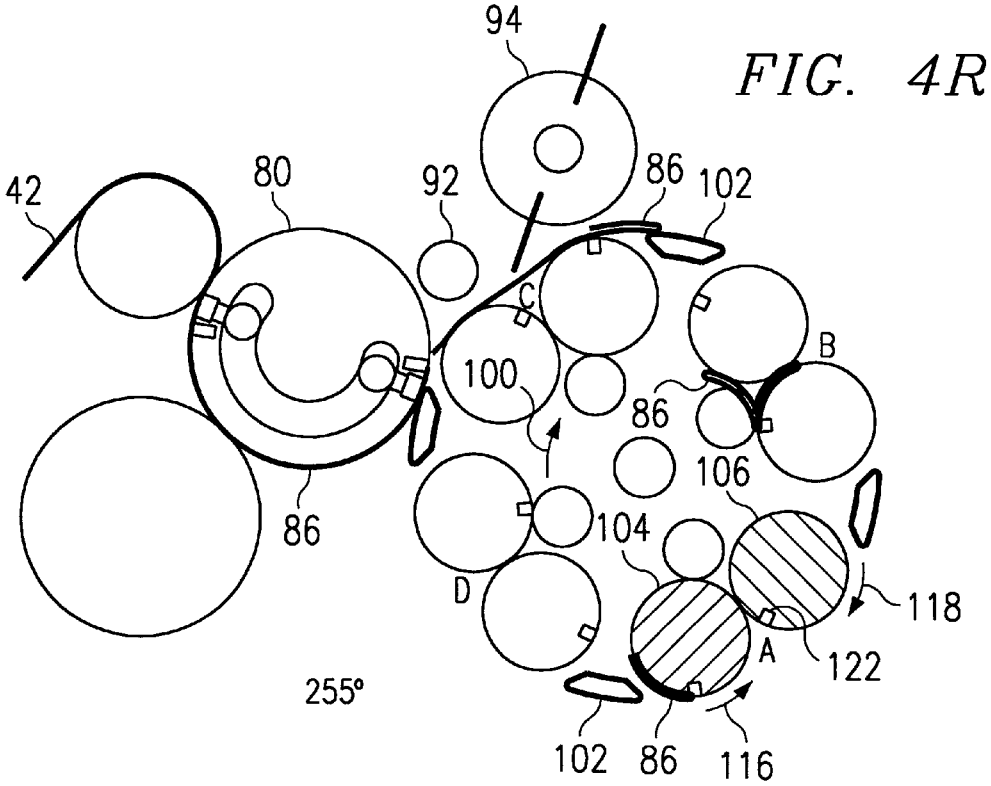
Figure 4S:
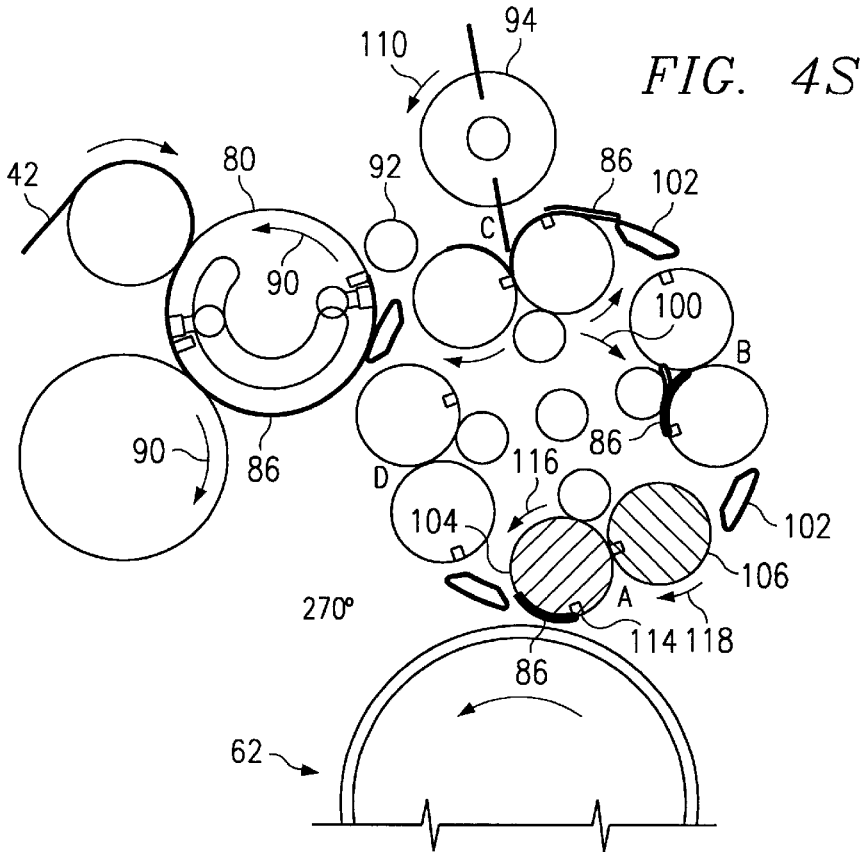
Figure 4T:
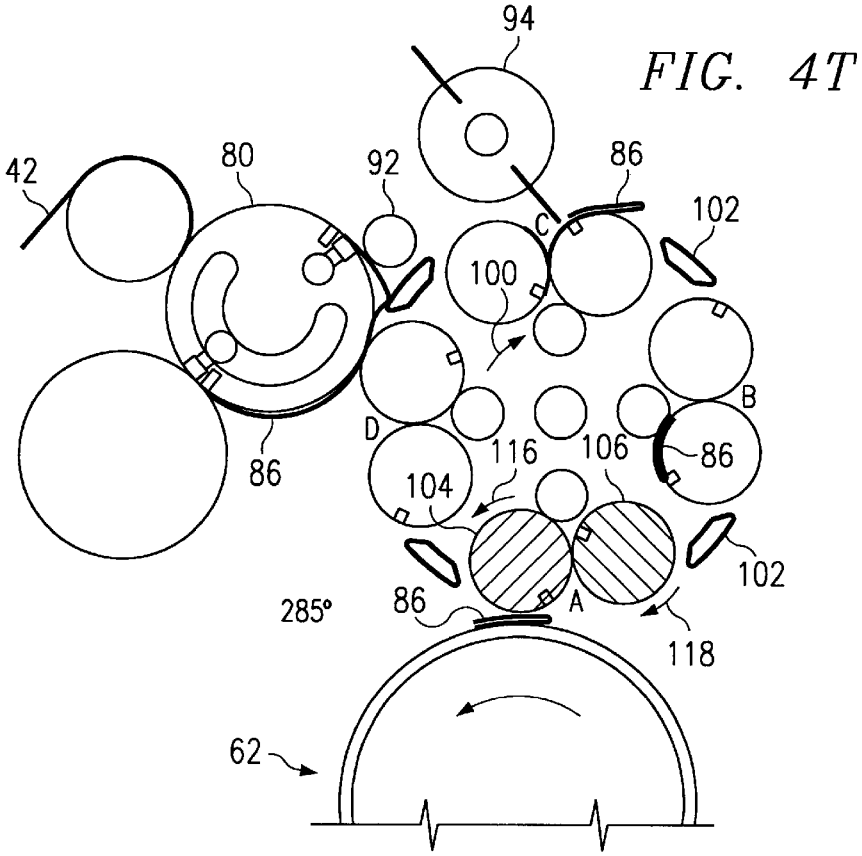
Figure 4U:
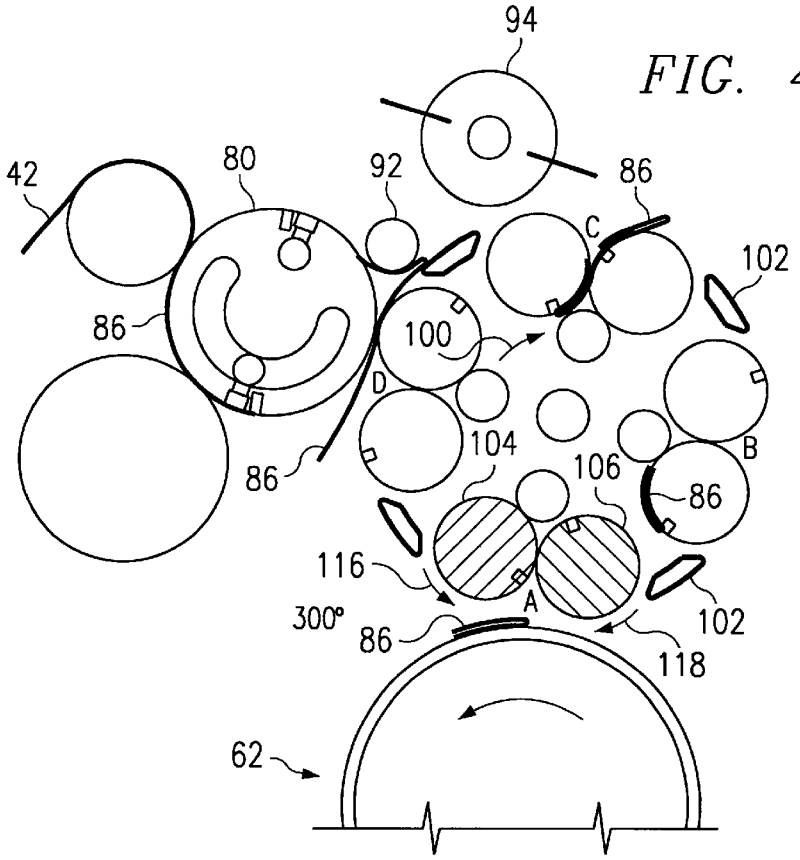
Figure 4V:
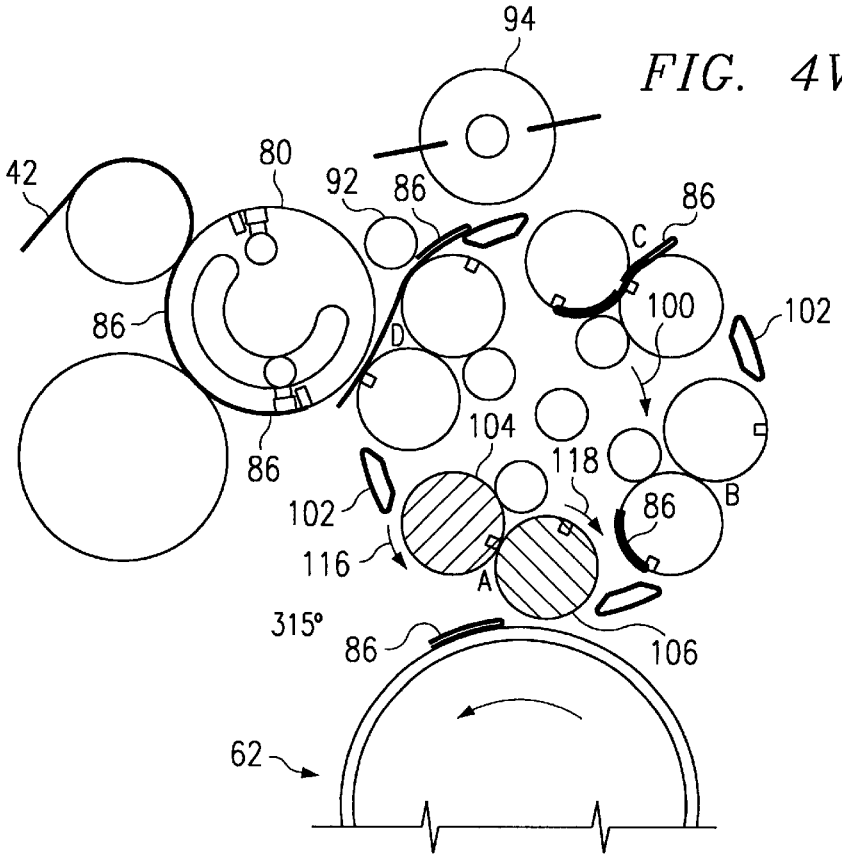
Figure 4W:
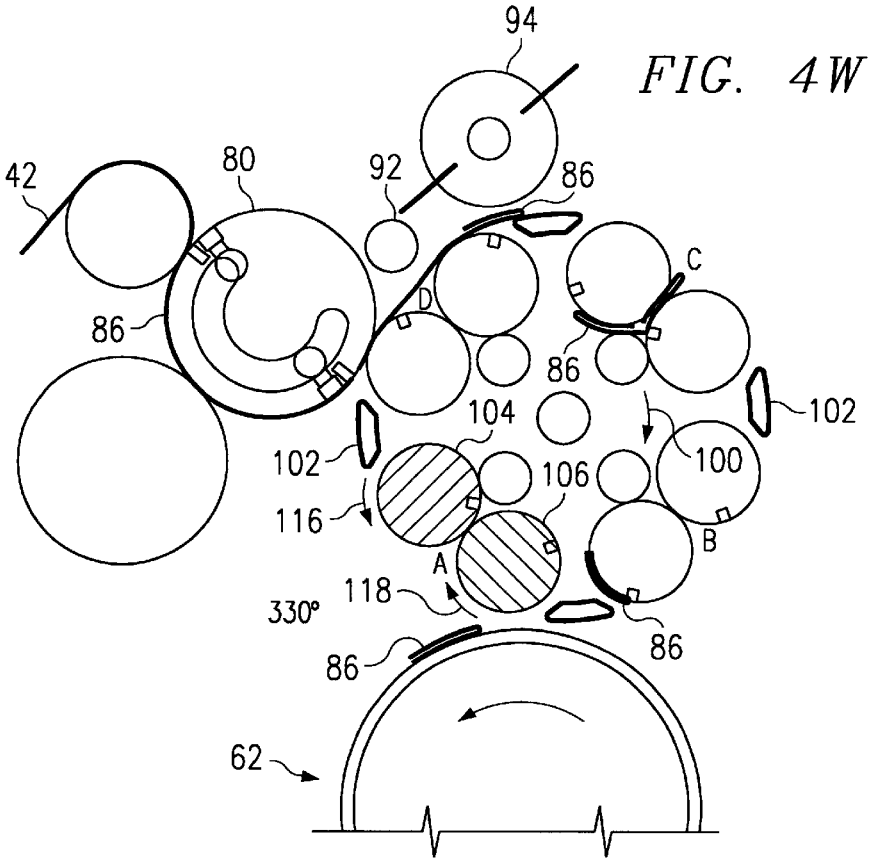
Figure 4X:
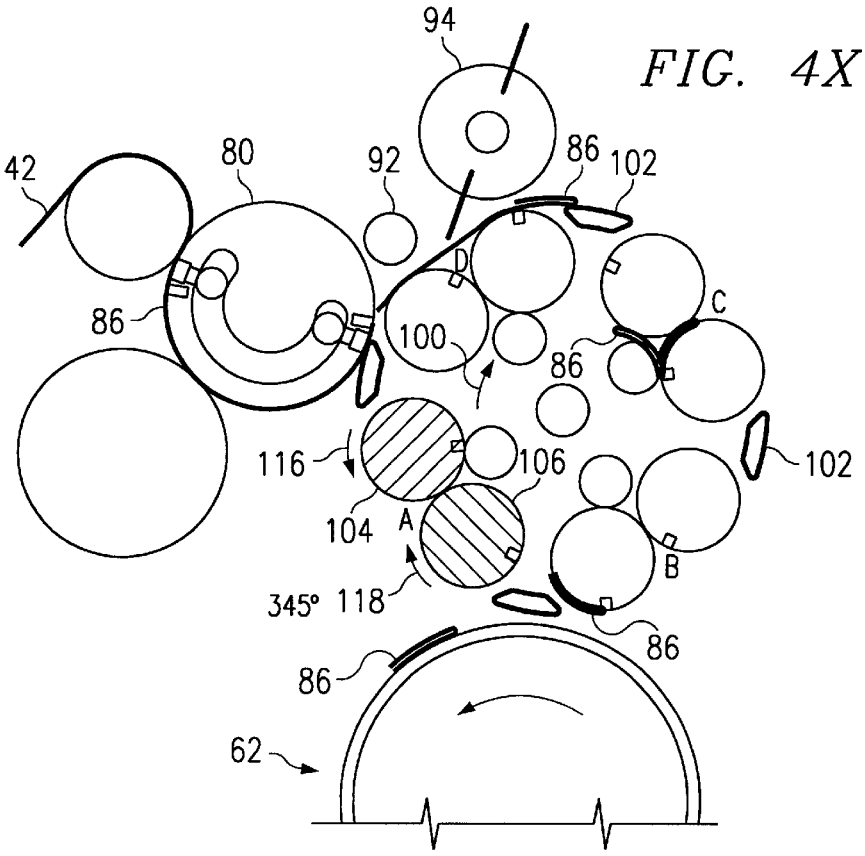

FIGS. 4A through 4X are diagrams illustrating a progression of web segments 86 through folding station 60. Referring to FIG. 4A, rotary folder 96 is identified as divided into stations A, B, C, and D. Stations A, B, C, and D of rotary folder 96 are rotating in the direction indicated by arrow 100. Additionally, tucking roller 94 is rotating in the direction indicated by arrow 110. As illustrated in FIG. 4A, the position of station A is indicated as zero degrees for purposes of describing folding operations during rotation of rotary folder 96.

Referring to FIG. 4A, as anvil roller 80 rotates in the direction indicated by arrow 90, vacuum port 88 is valved off, thereby releasing a leading edge of web segment 86. Pick-up shoe 102 comprises a vacuum port 112 disposed outwardly toward anvil roller 80 to retain web segment 86. Vacuum port 112 is valved on to receive and retain web segment 86 from anvil roller 80. Vacuum port 112 retains web segment 86 at a location approximately one-fourth of the longitudinal length of web segment 86 as measured from the leading edge of web segment 86.

Referring to FIG. 4B, as rotary folder 96 rotates to an approximately fifteen degree position, pick-up shoe 102 begins drawing web segment 86 away from anvil roller 80. Additionally, blades 82 of cutter roller 78 have engaged anvils 84 of anvil roller 80 to transversely sever the trailing edge of web segment 86 from web stream 42.

Referring to FIG. 4C, rotary folder 96 is disposed in an approximately thirty degree position. As rotary folder 96 continues to rotate, pick-up shoe 102 draws web segment 86 into a nip defined by pick-up shoe 102 and detour roller 92, thereby transversely folding the leading edge of web segment 86. As illustrated in FIGS. 4D and 4E, as rotary folder 96 continues rotation in the direction indicated by arrow 100 to an approximately forty-five degree and sixty degree position, approximately one-fourth of web segment 86 is transversely folded rearwardly towards a medial portion of web segment 86 to form a quarter-folded leading edge of web segment 86.

Referring to FIG. 4F, as rotary folder 96 rotates to an approximately seventy-five degree position, vacuum port 112 of pick-up shoe 102 is valved off while a vacuum port 114 of folding roller 104 is valved on to retain a medial portion of web segment 86. As illustrated in FIG. 4F, folding roller 104 is rotating in the direction indicated by arrow 116, and folding roller 106 is rotating in the direction indicated by arrow 118.

Referring to FIG. 4G, rotary folder 96 is disposed in an approximately ninety degree position. Tucker roller 94 comprises diametrically opposed tucking members 120, each tucking member 120 extending outwardly towards rotary folder 96 as tucking roller 94 rotates in the direction indicated by arrow 110. In operation, as rotary folder 96 and tucking roller 94 rotate in the directions indicated by arrows 100 and 110, respectively, tucking member 120 guides a portion of web segment 86 into a nip defined by adjacent folding rollers 104 and 106.

As folding rollers 104 and 106 rotate in the directions indicated by arrows 116 and 118, respectively, folding rollers 104 and 106 cooperate to transversely fold web segment 86 to form a quarter-folded trailing edge of web segment 86. A vacuum port 122 of folding roller 106 is valved on to retain the quarter-folded trailing edge of web segment 86. Additionally, pick-up shoe 102 of station B receives another web segment 86 from anvil roller 80.

Referring to FIGS. 4H and 4I, rotary folder 96 rotates to an approximately one hundred five degree and one hundred twenty degree position, respectively. Web segment 86 is drawn between the nip defined by adjacent folding rollers 104 and 106 to complete transverse folding of web segment 86 to form the quarter-folded trailing edge of web segment 86. Referring to FIG. 4J, as rotary folder 96 rotates to an approximately one hundred thirty-five degree position, vacuum port 122 of folding roller 106 is valved off, thereby releasing the quarter-folded trailing edge of web segment 86.

Referring to FIGS. 4K and 4L, as rotary folder 96 rotates to an approximately one hundred fifty degree and one hundred sixty-five degree position, vacuum port 114 of folding roller 104 draws a medial portion of web segment 86 into a nip defined by folding roller 104 and ironing roller 108. As folding roller 104 rotates in the direction indicated by arrow 116 and ironing roller 108 rotates in the direction indicated by arrow 124, web segment 86 is drawn into the nip defined by adjacent rollers 104 and 108 to transversely fold web segment 86 approximately in half. Thus, the quarter-folded leading edge of web segment 86 is folded inwardly toward the quarter-folded trailing edge of web segment 86.

FIGS. 4M–4R illustrate rotation of rotary folder 96 from an approximately one hundred eighty degree position to an approximately two hundred fifty-five degree position. As illustrated in FIGS. 4M–4R, stations B and C of rotary folder 96 receive and fold additional web segments 86 as rotary folder 96 rotates in the direction indicated by arrow 100. Additionally, folding roller 104 of station A continues rotating in the direction indicated by arrow 116 to complete folding of web segment 86.

FIGS. 4S–4X illustrate the delivery of web segments 86 from rotary folder 96 to transfer station 62. Referring to FIG. 4S, as rotary folder 96 rotates to an approximately two hundred seventy degree position, vacuum port 114 of folding roller 104 is valved off to release and transfer web segment 86 to transfer station 62. Additionally, folding of another web segment 86 begins at station D of rotary folder 96.

Referring to FIGS. 4T–4X, as rotary folder 96 continues rotation from an approximately two hundred eighty-five degree position to an approximately three hundred forty-five degree position, station A of rotary folder 96 is rotated in the direction indicated by arrow 100 toward anvil roller 80 to receive another web segment 86 and begin another cycle. Thus, rotary folder 96 provides continuous folding of web segments 86 by rotating folding stations A, B, C, and D three hundred sixty degrees, thereby providing an efficient and compact system 10 capable of producing multi-folded web segments 86.

Figure 5A:
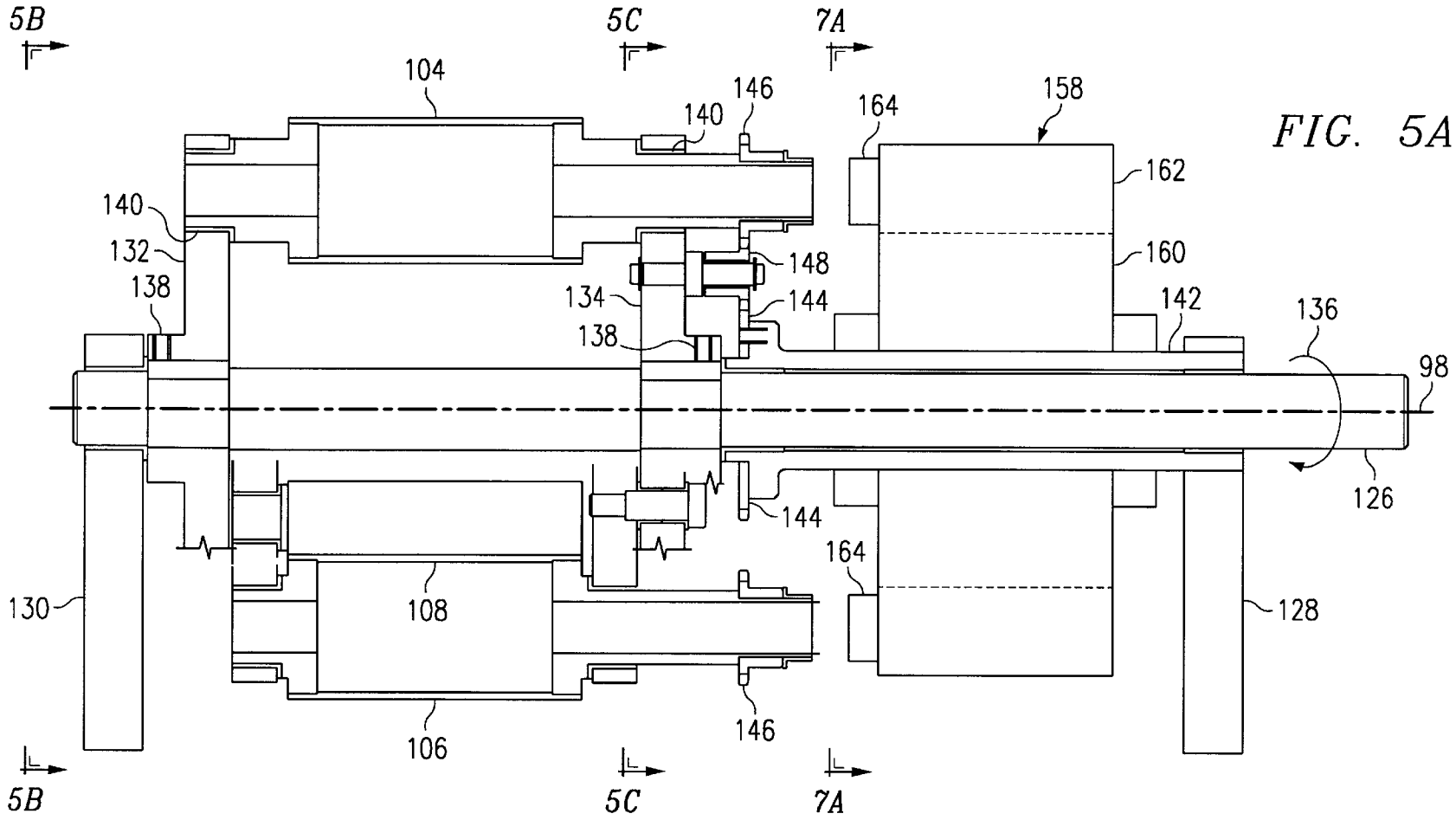
FIGS. 5A–5C are diagrams illustrating a rotary folder of the system in accordance with an embodiment of the present invention.
Figure 5C:
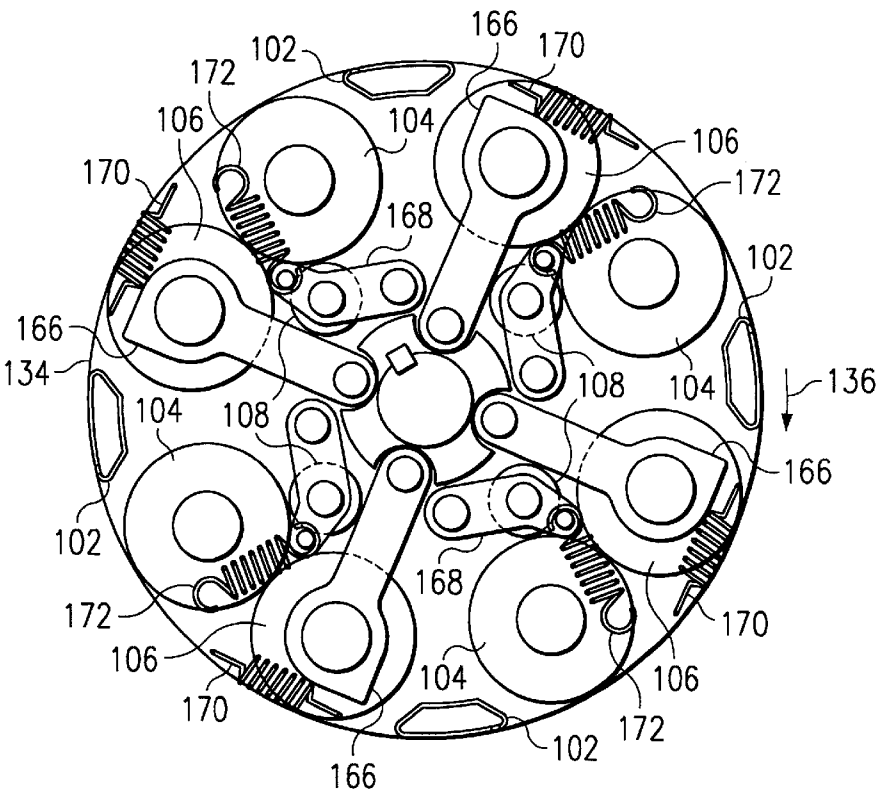
Figure 5B:
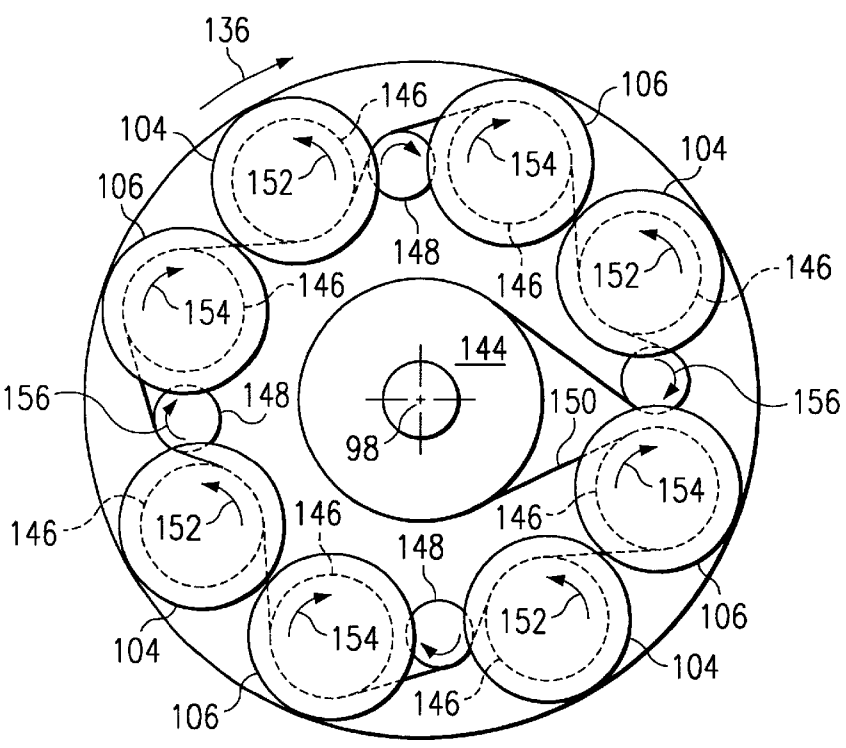

FIGS. 5A–5C are diagrams illustrating rotary folder 96 in accordance with an embodiment of the present invention. Referring to FIGS. 5A and 5B, rotary folder 96 comprises a shaft 126 rotatably coupled to supports 128 and 130. Rotary folder 96 also comprises rotary frames 132 and 134 fixedly coupled to shaft 126 such that rotation of shaft 126 in the direction indicated by arrow 136 causes rotation of rotary frames 132 and 134 in the same direction as indicated by arrow 136. Rotary frames 132 and 134 may be secured to shaft 126 using pins 138; however, other suitable devices or methods may be used to secure rotary frames 132 and 134 to shaft 126.

Folding rollers 104 and 106 and ironing rollers 108 are rotatably coupled to openings 140 of rotary frames 132 and 134. Additionally, pick-up shoes 102 are fixedly attached to rotary frames 132 and 134. Thus, rotation of rotary frames 132 and 134 in the direction indicated by arrow 136 also causes rotation of folding rollers 104 and 106, ironing rollers 108, and pick-up shoes 102 in the direction indicated by arrow 136 about axis 98. Shaft 126 is disposed within a stationary stud 142 having one end fixedly attached to support 128. An opposite end of stationary stud 142 is fixedly attached to a sun sprocket 144.

Rotary folder 96 also comprises a plurality of planet sprockets 146 rotatably coupled to rotary frame 134 and fixedly attached to each folding roller 104 and 106. Additionally, rotary folder 96 comprises a plurality of idler sprockets 148 rotatably coupled to rotary frame 134. In operation, as shaft 126 rotates in the direction indicated by arrow 136, rotary frames 132 and 134 also rotate in the same direction, thereby causing folding rollers 104 and 106, ironing roller 108, and pick-up shoe 102 to rotate in the direction indicated by arrow 136 relative to axis 98. As rotary frame 134 rotates in the direction indicated by arrow 136, a chain 150 coupled between sun sprocket 144, planet sprockets 146, and idler sprockets 148 causes rotation of planet sprockets 146 and idler sprockets 148 in the directions indicated by arrows 152, 154, and 156, respectively, thereby causing counter-rotation of folding rollers 104 and 106.

Sun sprocket 144 and planet sprockets 146 are sized to have a teeth ratio such that folding rollers 104 rotate counterclockwise one revolution in the direction indicated by arrow 152 for each revolution of rotary frame 134 in the direction of arrow 136. Folding rollers 106 rotate clockwise three revolutions in the direction indicated by arrow 154 for each revolution of rotary frame 134 in the direction indicated by arrow 136. Additionally, because rotary frame 134 is rotating in the clockwise direction as indicated by arrow 136, folding rollers 106 rotate one revolution in the clockwise direction for each revolution of folding rollers 104 in the counterclockwise direction. For example, sun sprocket 144 may be sized having twenty-eight teeth and planet sprockets 146 having fourteen teeth.

Rotary folder 96 also comprises a vacuum block 158 to provide an intermittent vacuum supply to folding rollers 104 and 106 and pick-up shoes 102. As illustrated in FIG. 5A, vacuum block 158 comprises a stator 160 fixedly attached to stationary stud 142 and a rotor 162 rotatably coupled to stator 160. Vacuum block 158 also comprises outlet ports 164 operable to couple to folding rollers 104 and 106 and pick-up shoes 102 to provide vacuum communication to folding rollers 104 and 106 and pick-up shoes 102. In operation, as rotary frame 134 rotates in the direction indicated by arrow 136, rotor 162 rotates in the direction indicated by arrow 136 relative to stator 160.

As illustrated in FIG. 5C, folding rollers 106 are pivotally secured to rotary frame 134 via arms 166. Additionally, ironing rollers 108 are pivotally secured to rotary frame 134 via arms 168. Springs 170 secure folding rollers 106 at a predetermined gap (not explicitly shown) from folding rollers 104 while providing pivotal movement of folding rollers 106 relative to folding rollers 104 to accommodate web segment passage between folding roller 104 and 106. Additionally, springs 172 secure ironing rollers 108 against folding rollers 104 while providing pivotal movement of ironing rollers 108 relative to folding rollers 104 to accommodate web segment passage between folding rollers 104 and ironing rollers 108.

Figure 6A:
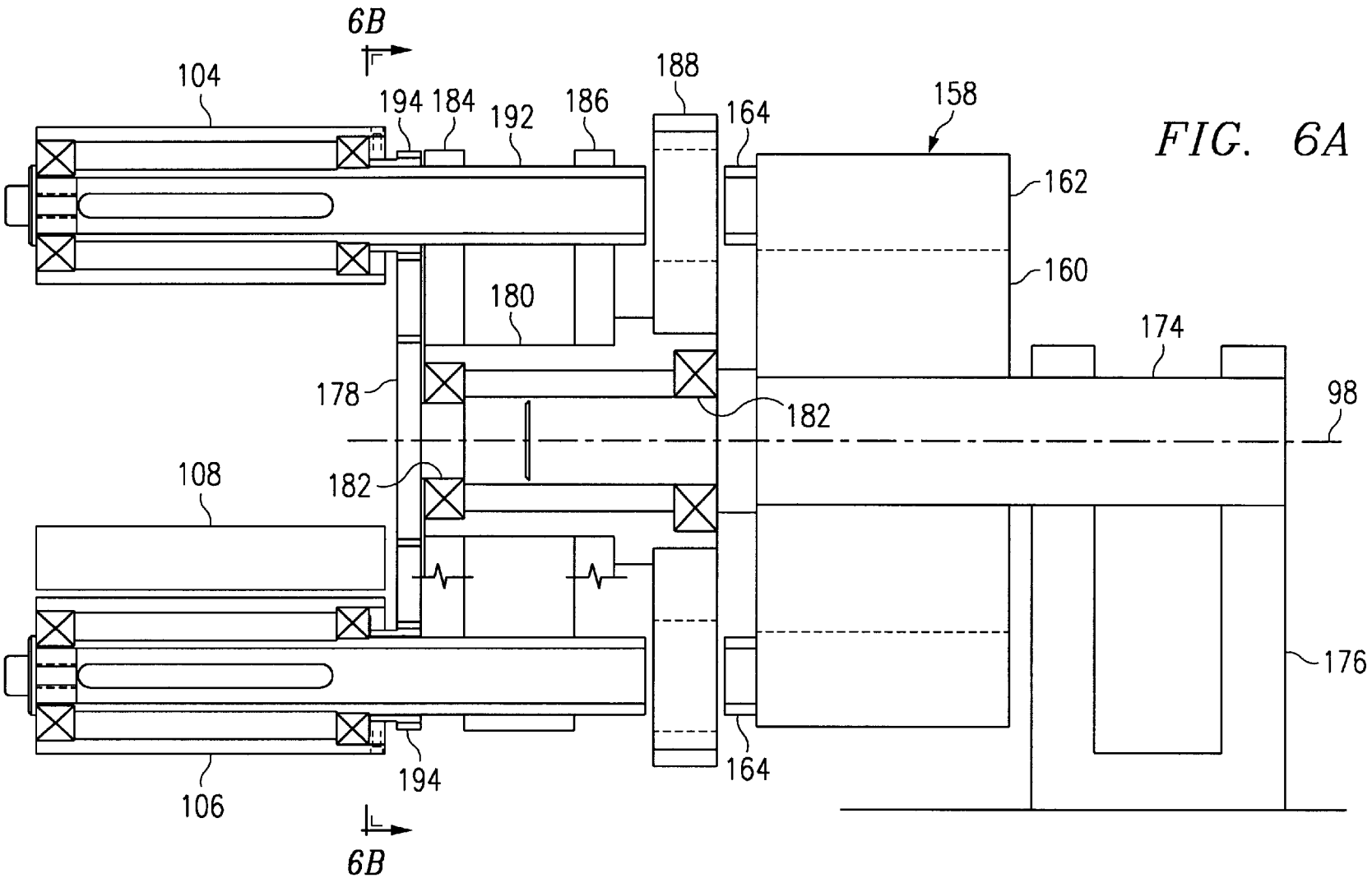
FIGS. 6A–6B are diagrams illustrating an alternative rotary folder of the system in accordance with an embodiment of the present invention.
Figure 6B:
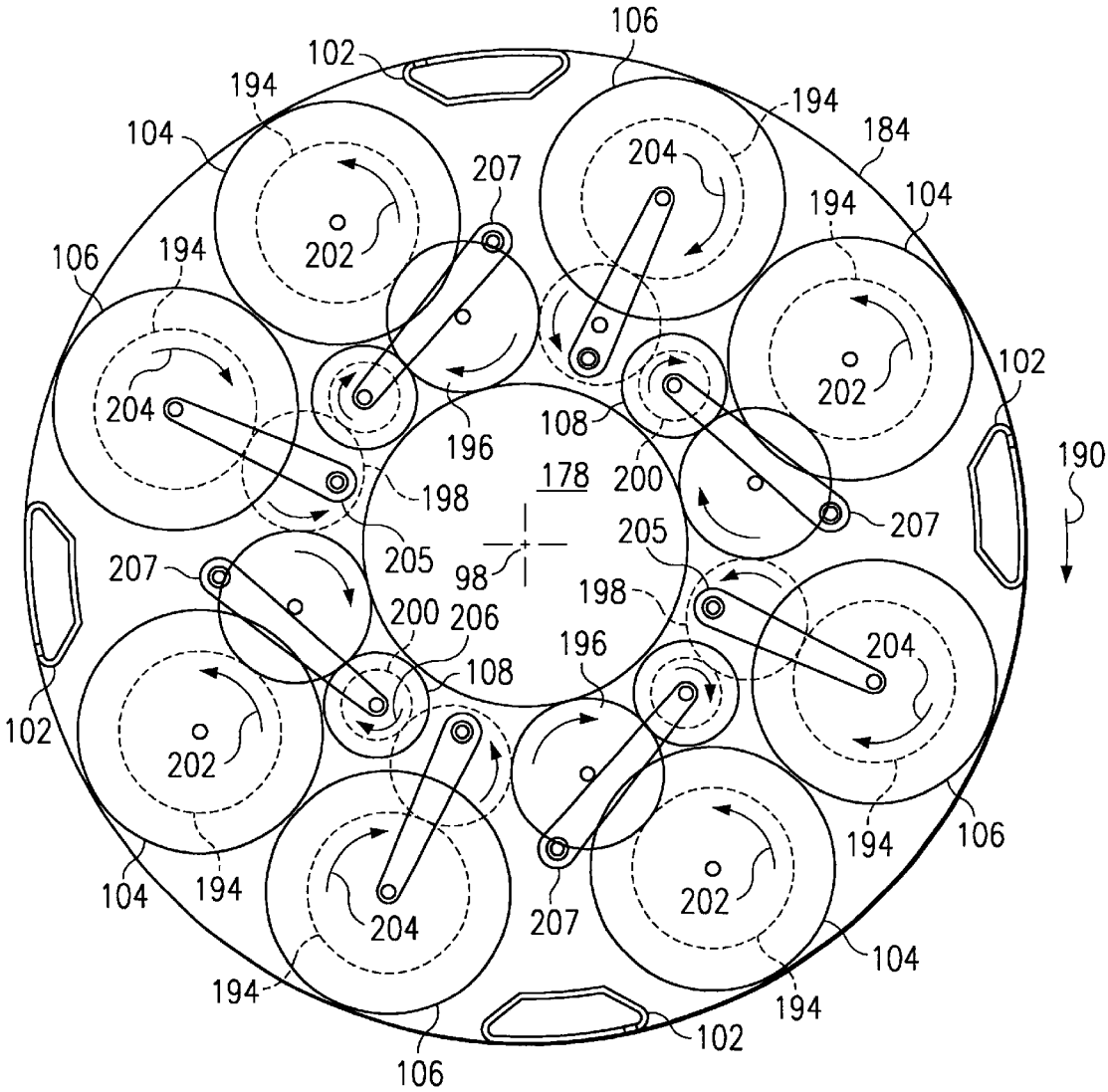

FIGS. 6A and 6B are diagrams illustrating an alternate embodiment of rotary folder 96 in accordance with the teachings of the present invention. In this embodiment, rotary folder 96 comprises a stationary stud 174 coupled at one end to a support 176 and coupled at an opposite end to a sun gear 178. A hub 180 is rotationally coupled to stationary stud 174 between support 176 and sun gear 178. Hub 180 rotates about an exterior surface of stationary stud 174 using bearings 182; however, other suitable methods or devices may be used to rotationally couple hub 180 to stationary stud 174.

Rotary folder 96 also comprises rotary frames 184 and 186 fixedly attached to an outer surface of hub 180. A drive gear 188 is also fixedly attached to the outer surface of hub 180. In operation, drive gear 188 receives input from an input gear, drive belt, or other suitable input mechanism (not explicitly shown), thereby causing rotation of drive gear 188, rotary frames 184 and 186, and hub 180 about axis 98 in the direction indicated by arrow 190. Rotary frames 184 and 186 comprise openings 192 for receiving and rotatably coupling folding rollers 104 and 106 and ironing rollers 108. Pick-up shoes 102 are also fixedly attached to rotary frame 184 disposed outwardly adjacent folding rollers 104 and 106. Thus, in operation, as rotary frames 184 and 186 rotate about axis 98 in the direction indicated by arrow 190, pick-up shoes 102, folding rollers 104 and 106, and ironing rollers 108 also rotate about axis 98 in the direction indicated by arrow 190.

Rotary folder 96 also comprises planet gears 194 fixedly attached to folding rollers 104 and 106 and rotatably coupled to rotary frame 184. Rotary folder 96 also comprises idler gears 196, 198, and 200. Idler gears 196 are rotatably coupled to rotary frame 184 and are disposed between sun gear 178 and planet gears 194 associated with folding rollers 104 such that idler gears 196 engage sun gear 178 and planet gears 194 associated with folding rollers 104. Idler gears 198 are also rotatably coupled to rotary frame 184 and engage idler gears 196 and planet gears 194 associated with folding rollers 106. Idler gears 200 are rotatably coupled to rotary frame 184, fixedly attached to ironing rollers 108, and engage adjacent idler gears 198.

In operation, as rotary frames 184 and 186 rotate about axis 98 in the direction indicated by 190, idler gears 196 also rotate about axis 98 in the direction indicated by 190 and cooperate with sun gear 178, thereby causing rotation of planet gears 194 associated with folding rollers 104 in a direction indicated by arrow 202. Idler gears 196 also cooperate with idler gears 198, thereby causing rotation of planet gears 194 associated with folding rollers 106 to rotate in the direction indicated by arrow 204. In turn, idler gears 198 cooperate with idler gears 200, thereby causing rotation of idler gears 200 and associated ironing rollers 108 in the direction indicated by arrow 206.

Thus, folding rollers 104 complete one counterclockwise revolution in the direction indicated by arrow 202 for each revolution of rotary frame 184 in the direction indicated by arrow 190. Additionally, folding rollers 106 complete three clockwise revolutions in the direction indicated by arrow 204 for each revolution of rotary frame 184 in the direction indicated by arrow 190. Additionally, because rotary frame 184 is rotating in the clockwise direction as indicated by arrow 190, folding rollers 106 rotate one revolution in the clockwise direction for each revolution of folding rollers 104 in the counterclockwise direction. For example, sun gear 178 may be sized to have sixty-four teeth, planet gears 194 may be sized to have thirty-two teeth, idler rollers 196 may be sized to have thirty teeth, idler rollers 198 may be sized to have twenty-four teeth, and idler rollers 200 may be sized to have fourteen teeth to produce the above-described rotational characteristics of rotary folder 96. However, other suitable configurations may be used to provide the rotational characteristics of rotary folder 96.

As illustrated in FIG. 6B, folding rollers 106 are pivotally secured to rotary frame 184 via arms 205. Additionally, ironing rollers 108 are pivotally secured to rotary frame 184 via arms 207. Springs as illustrated in FIG. 5C may be used to secure folding rollers 106 at a predetermined gap (not explicitly shown) from folding rollers 104 while providing pivotal movement of folding rollers 106 relative to folding rollers 104 to accommodate web segment passage between folding roller 104 and 106. Additionally, springs as illustrated in FIG. 5C may be used to secure ironing rollers 108 at a predetermined gap (not explicitly shown) from folding rollers 104 while providing pivotal movement of ironing rollers 108 relative to folding rollers 104 to accommodate web segment passage between folding rollers 104 and ironing rollers 108.

Figure 7C:
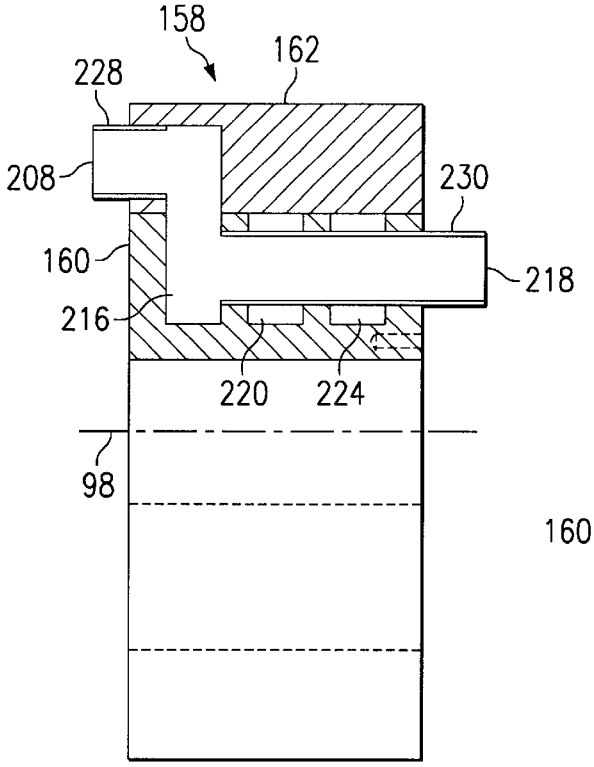

FIGS. 7A–7H are diagrams illustrating vacuum block 158 in accordance with an embodiment of the present invention. Referring to FIGS. 7A and 7B, rotor 162 of vacuum block 158 comprises outlet ports 208, 210, and 212 to provide vacuum communication with folding rollers 104, folding rollers 106, and pick-up shoes 102, respectively. Thus, outlet ports 208, 210, and 212 are coupled to folding rollers 104 and 106 and pick-up shoes 102 such that rotor 162 rotates relative to stator 160 in the direction indicated by arrow 214 as, referring to FIG. 6A, rotary frames 184 and 186 rotate about axis 98. Stator 160 may be constructed from steel or other suitable materials. Rotor 162 may be constructed from ultra high molecular weight polyethylene (UHMW) to provide bearing properties for rotation of rotor 162 relative to stator 160; however, rotor 162 may be constructed from other suitable materials to provide rotation of rotor 162 relative to stator 160. Vacuum block 158 is illustrated in FIG. 7A in an approximately seventy-five degree position corresponding with FIG. 4F.

Stator 160 comprises an annular chamber 216 to provide vacuum communication between outlet port 208 and an inlet port 218 to provide a vacuum supply to folding rollers 104. Stator 160 also comprises an annular chamber 220 to provide vacuum communication between outlet port 210 and an inlet port 222 to provide a vacuum supply for folding rollers 106. Stator 160 also comprises an annular chamber 224 to provide vacuum communication between outlet port 212 and an inlet port 226 to provide a vacuum supply to pick-up shoes 102.

Figure 7D:
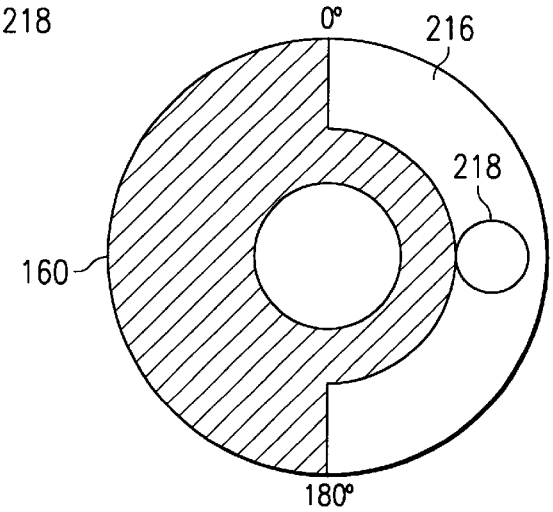

FIGS. 7C and 7D are diagrams illustrating the vacuum communication path through vacuum block 158 corresponding to folding rollers 104. As illustrated in FIG. 7C, vacuum block 158 comprises laterally spaced apart annular chambers 216, 220, and 224. Outlet ports 208 are coupled to folding rollers 104 and inlet port 218 is coupled to a vacuum supply (not explicitly shown). Tubes 228 and 230 or other suitable vacuum communication devices may be inserted into outlet ports 208 and inlet port 218, respectively, to couple the vacuum supply through vacuum block 158 to folding rollers 104. Additionally, tube 230 prevents communication of the vacuum supply for folding rollers 104 to chambers 220 and 224. For example, stator 160 may be constructed having chambers 216, 220, and 224 extending circumferentially about stator 160. Blocks or other suitable obstructions (not explicitly shown) may be positioned within chambers 216, 220, and 224 to limit the vacuum path within chambers 216, 220, and 224 as illustrated in FIGS. 7D, 7F, and 7H, respectively. Alternatively, stator 160 may be constructed by limiting material removal from stator 160 to the locations illustrated in FIGS. 7D, 7F, and 7H to form chambers 216, 220, and 224, respectively. However, stator 160 may also be constructed using other suitable methods.

Referring to FIG. 7D, chamber 216 extends within stator 160 from an approximately zero degree position to an approximately one hundred eighty degree position while stator 160 is located in the approximately seventy-five degree position as illustrated in FIG. 7A. Thus, as rotor 162 rotates about stator 160, vacuum block 158 provides a vacuum supply to folding rollers 104 while outlet ports 208 are disposed over chamber 216.

Figure 7E:
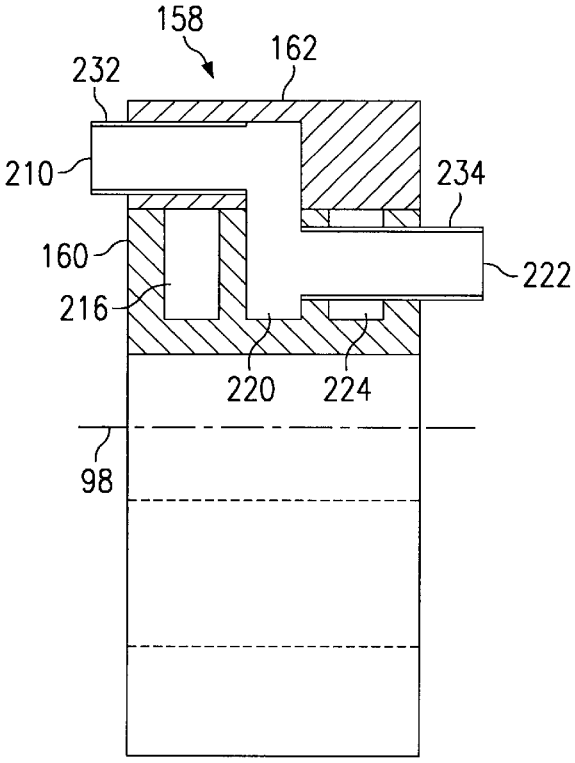
Figure 7F:
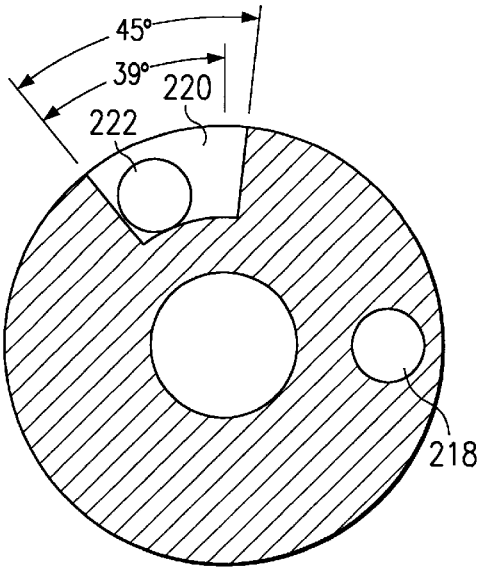

FIGS. 7E and 7F are diagrams illustrating valve block 158 for providing vacuum communication to folding rollers 106. Outlet ports 210 are coupled to folding rollers 106 and inlet port 222 is coupled to a vacuum supply (not explicitly shown). Tubes 232 and 234 or other suitable vacuum communication devices may be inserted into outlet ports 210 and inlet port 222, respectively, to couple the vacuum supply through vacuum block 158 to folding rollers 106. Additionally, tube 234 prevents communication of the vacuum supply for folding rollers 106 to chamber 224.

Referring to FIG. 7F, chamber 220 extends within stator 160 approximately forty-five degrees as measured from an approximately three hundred twenty-one degree position to an approximately six degree position while stator 160 is located in the approximately seventy-five degree position as illustrated in FIG. 7A. In operation, as rotor 162 rotates about stator 160, vacuum block 158 provides a vacuum supply to folding rollers 106 while outlet ports 2210 are disposed over chamber 220.

FIGS. 7G and 7H are diagrams illustrating vacuum block 158 for providing vacuum communication between the vacuum supply and pick-up shoes 102. Outlet ports 212 are coupled to pick-up shoes 102 and inlet port 226 is coupled to a vacuum supply (not explicitly shown). Tubes 236 and 238 or other suitable vacuum communication devices may be inserted into outlet ports 212 and inlet port 226, respectively, to couple the vacuum supply through vacuum block 158 to pick-up shoes 102.

Referring to FIG. 7H, chamber 224 extends within stator 160 approximately one hundred five degrees as measured from an approximately two hundred eighty degree position to an approximately twenty-five degree position while stator 160 is located in the approximately seventy-five degree position as illustrated in FIG. 7A. In operation, as rotor 162 rotates about stator 160, vacuum block 158 provides a vacuum supply to pick-up shoes 102 while outlet ports 212 are disposed over chamber 224.

Figure 8:
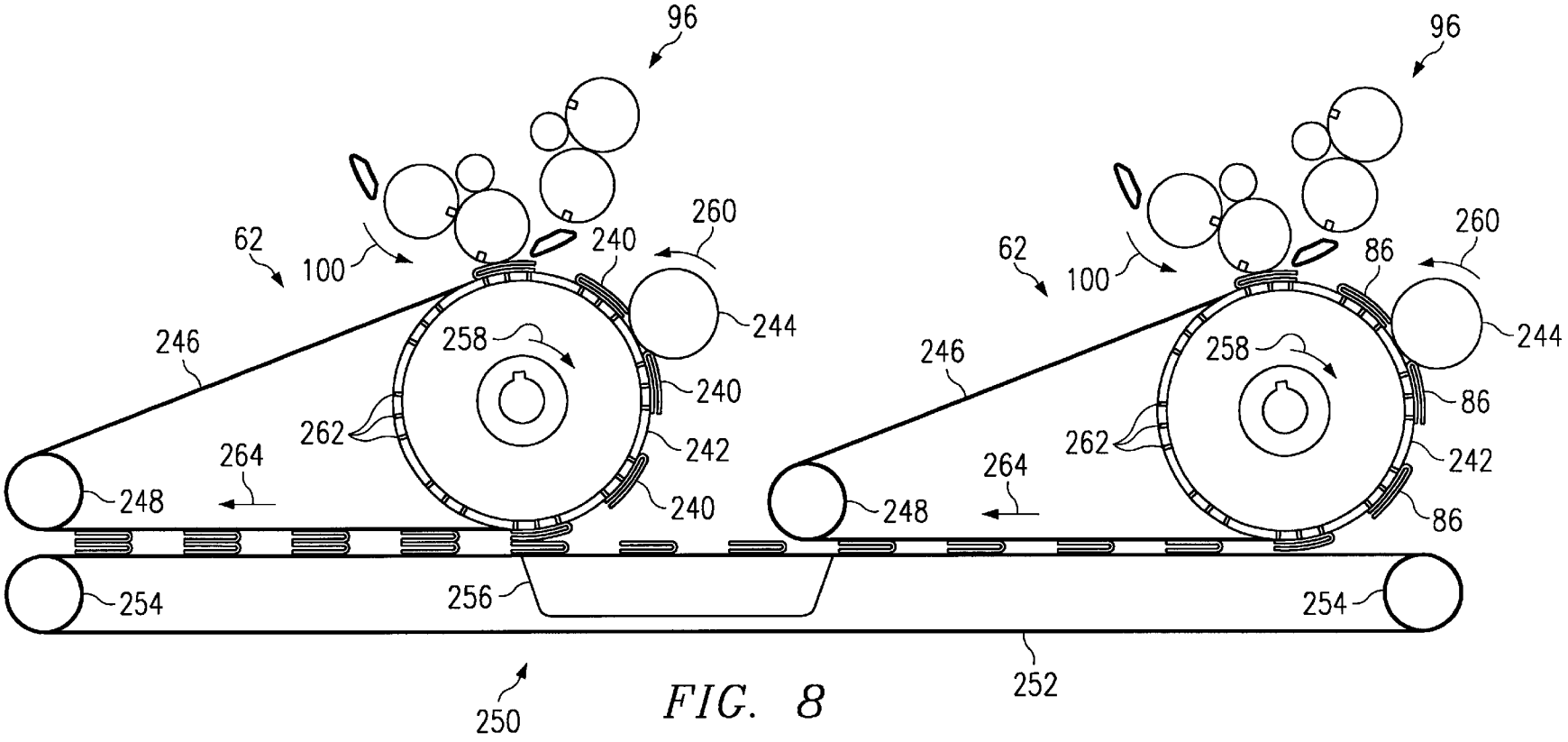
FIG. 8 is a diagram illustrating a transfer station of the system in accordance with an embodiment of the present invention.

FIG. 8 is a diagram illustrating transfer stations 62 in accordance with an embodiment of the present invention. As described above with respect to web stream 42 and web segments 86, web stream 44 is segmented and folded in a similar manner to form web segments 240.

Each transfer station 62 comprises a folding drum 242 and a creasing roller 244. Transfer stations 62 each also comprise a stripper belt 246 coupled between folding drum 242 and an idler roller 248. System 10 also comprises a combining conveyor 250 extending between transfer stations 62. Combining conveyor 250 comprises a conveyor belt 252 coupled between conveyor rollers 254 and a vacuum station 256 disposed between adjacent transfer stations 62.

In operation, rotary folders 96 transfer web segments 86 and 240 to folding drums 242. Folding drums 242 rotate in the direction indicated by arrows 258 to transfer web segments 86 and 240 from folding rollers 96 to combining conveyor 250. Creasing rollers 244 may be used to crease web segments 86 and 240 in preparation for additional folding operations. Creasing rollers 244 rotate in the direction indicated by arrows 260.

Folding drums 242 comprise vacuum ports 262 to retain web segments 86 and 240 as web segments 86 and 240 are transferred from rotary folders 96 to combining conveyor 250. Stripper belts 246 and conveyor belt 252 are disposed in above-and-below relation to each other and operate to pinch and secure web segments 86 and 240 as vacuum ports 262 are valved off to release web segments 86 and 240. Stripper belts 246 are driven by folding drums 242 at a velocity substantially equal to the velocity of conveyor belt 252 to provide a smooth transfer of web segments 86 and 240 from folding drums 242 to combining conveyor 250.

Transfers stations 62 and combining conveyor 250 may also be used to superpose web segments 86 and 240. For example, web segments 86 are delivered to combining conveyor 250 by folding drum 242 and are fed downstream by conveyor belt 252 in the direction indicated by arrow 264. As web segments 86 travel beyond stripper belt 246, vacuum station 256 operates to secure web segments 86 to conveyor belt 252 as web segments 86 travel between transfer stations 62. Transfer stations 62 may be spaced apart such that web segments 86 may be paired with a corresponding web segment 240 as web segments 86 travel along conveyor belt 252. Thus, as web segments 86 are fed downstream, folding drum 242 superposes web segments 240 with web segments 86. Superposed web segments 86 and 240 are secured between stripper belt 246 and conveyor belt 250 and are fed downstream.

Additionally, transfer stations 62 may also be used to modify the spacing or interval between successive web segments 86 and 240 to coordinate with a subsequent packaging registration. For example, superposed web segments 86 and 240 may be transferred from combining conveyor 250 to a packaging station (not explicitly shown) to individually package each superposed pair of web segments 86 and 240. The packaging station may comprise a rotary sealer (not explicitly shown) or other suitable type of automatic packaging system. Thus, the packaging station may include a registration or interval for individually packaging each pair of superposed web segments 86 and 240. Accordingly, the superposed web segments 86 and 240 are delivered to the packaging station at a spacing substantially matching the packaging registration.

Folding drums 242 and corresponding stripper belts 246 may be operated at a predetermined velocity independent from a velocity of rotary folder 96 to modify the spacing between successive web segments 86 and 240 as web segments 86 and 240 are received from rotary folders 96. For example, folding drums 242 and corresponding stripper belts 246 may be operated at a velocity greater than or less than a velocity of rotary folders 96 to increase or decrease, respectively, the spacing between successive web segments 86 and 240. Thus, folding drums 242 may be operated to positively or negatively accelerate web segments 86 and 240 as web segments 86 and 240 are received from rotary folders 96 to modify the spacing between successive web segments 86 and 240.

FIGS. 9A–9B are diagrams illustrating a spacing relationship between successive web segments 86 as web segments 86 are fed downstream from cutting station 58, through rotary folder 96, and then to transfer station 62. At cutting station 58, web segments 86 have a spacing or interval as measured from leading edge to leading edge of successive web segments 86 as indicated by dimension 266. After web segments 86 are folded using rotary folder 96 at folding station 60, the spacing between successive web segments 86 as measured from leading edge to leading edge of folded successive web segments 86 is indicated by dimension 268.

In the embodiment illustrated in FIG. 9, folding drum 242 is operated at a velocity less than a velocity of rotary folder 96, thereby negatively accelerating web segments 86 as web segments 86 are transferred from rotary folder 96 to folding drum 242. Thus, the spacing or interval between successive web segments 86 is reduced as indicated by dimension 269. However, folding drums 242 may also be operated at a velocity greater than the velocity of rotary folders 96, thereby positively accelerating web segments 86 to increase the spacing between successive web segments 86.

Therefore, the present invention provides greater flexibility than prior systems by delivering web products at a predetermined spacing to correspond with spacing or registration requirements of packaging systems. Although the present invention has been described as being associated with producing superposed web products, the present invention may also be associated with producing a single web product without departing from the intended scope of the present invention.

FIGS. 10A–10D are diagrams illustrating folding drum 242 in accordance with an embodiment of the present invention. Folding drum 242 comprises a drum cover 270 fixedly attached to a spindle 272. Folding drum 242 also comprises laterally disposed valve blocks 274, 276, 278, and 280. Valve blocks 274, 276, 278, and 280 are secured to each other and secured to a valve hub 282. Valve blocks 274, 276, 278, and 280 may be secured to each other and to valve hub 282 using fasteners 284; however, other suitable methods or devices may be used to secure valve blocks 274, 276, 278, and 280 to each other and to valve hub 282. Additionally, valve blocks 274, 276, 278, and 280 are secured to a support 286 to prevent rotation of valve blocks 274, 276, 278, and 280.

In operation, spindle 272 receives a rotational input, thereby causing rotation of spindle 272 and drum cover 270 relative to valve hub 282 and valve blocks 274, 276, 278, and 280. Drum cover 270 and spindle 272 may be constructed using steel or other suitable materials. Valve blocks 274, 276, 278, and 280 may be constructed from a bearing material such as ultra high molecular weight polyethylene (UHMW); however, other suitable materials may be used for constructing valve blocks 274, 276, 278, and 280 to provide rotational movement of drum cover 270 relative to valve blocks 274, 276, 278, and 280.

Valve blocks 274, 276, 278, and 280 comprise annular chambers 288, 290, 292, and 294, respectively, for providing vacuum communication to drum cover 270. For example, valve block 280 comprises a passage 296 to provide vacuum communication between chambers 288, 290, 292, and 294 and a vacuum supply (not explicitly shown). Each annular chamber 288, 290, 292, and 294 extends a predetermined circumferential distance about valve blocks 274, 276, 278, and 280, respectively, such that the vacuum supply is valved off in particular chambers as drum cover 270 rotates in the direction indicated by arrow 298.

For example, referring to FIG. 10B, chamber 290 extends approximately one hundred eighty degrees from a position 300 to a position 302. Thus, chamber 290 provides vacuum communication to drum cover 270 while web segments 86 and 240 are delivered from rotary folders 96 to combining conveyor 250. Chamber 292 is illustrated as extending approximately eighty degrees from position 300 to a position 304, and chambers 288 and 294 are illustrated as extending approximately forty degrees from position 300 to a position 306. Thus, vacuum communication to drum cover 270 is valved off for chambers 288 and 294 at position 306, and vacuum communication to drum cover 270 is valved off for chamber 292 at position 304. However, the circumferential lengths of chambers 288, 290, 292, and 294 may be varied to accommodate various retain and release positions of web segments as drum cover 270 rotates relative to chambers 288, 290, 292, and 294.

In operation, chambers 288, 290, 292, and 294 are valved on and off to secure and release, respectively, portions of web segments 86 and 240 for longitudinally folding of web segments 86 and 240. For example, referring to FIGS. 10A, 10B and 10D, for web segments 86 and 240 having a width extending laterally across chambers 290 and 292, as drum cover 270 rotates in the direction indicated by arrow 298, chamber 292 is valved off at position 304 and an air stream from an air nozzle 308 disposed adjacent folding drum 242 may be used to longitudinally fold a portion of web segment 86 and 240 from a position 310 to a position 312. Additionally, vacuum communication to chamber 290 remains valved on to retain the portion of web segments 86 and 240 relative to chamber 290 from position 300 to position 302.

Additionally, for example, for web segments 86 and 240 extending laterally across chambers 288, 290, and 292, chamber 288 is valved off at position 306 and an air stream from an air nozzle 314 disposed adjacent folding drum 242 may be used to longitudinally fold a portion of web segment 86 and 240 from a position 316 to a position 318. As drum cover 270 continues rotation in the direction indicated by arrow 298, chamber 292 is valved off at position 304 and an air stream from air nozzle 308 may be used to longitudinally fold a portion of web segments 86 and 240 from a position 320 to a position 322. Vacuum communication to chamber 290 remains valved on to retain the portion of web segments 86 and 240 relative to chamber 290 from position 300 to position 302.

Further, for example, for web segments 86 and 240 extending laterally across chambers 288, 290, 292, and 294, chambers 288 and 294 are valved off at position 306. An air stream from air nozzle 314 and an air stream from an air nozzle 315 may be used to longitudinally fold portions of web segments 86 and 240 from positions 324 and 326 to positions 328 and 330, respectively. As drum cover 270 continues rotation in the direction indicated by arrow 298, chamber 292 is valved off at position 304 and an air stream from air nozzle 308 may be used to longitudinally fold a portion of web segments 86 and 240 from a position 332 to a position 334. Air nozzles 308, 314, and 315 may be positioned on each side and at various locations adjacent folding drum 242 to provide air streams to longitudinally fold portions of web segments 86 and 240 as chambers 288, 292, and 294 are valved off. Vacuum communication to chamber 290 remains valved on to retain the portion of web segments 86 and 240 relative to chamber 290 from position 300 to position 302.

Although air nozzles 308 and 314 are illustrated in FIG. 10A to provide air streams for folding portions of web segments 86 and 240, other suitable methods or devices may also be used to longitudinally fold portions of web segments 86 and 240 as drum cover 270 rotates, such as, but not limited to, mechanical arms or folding plows disposed adjacent folding drum 242.

Figure 10C:
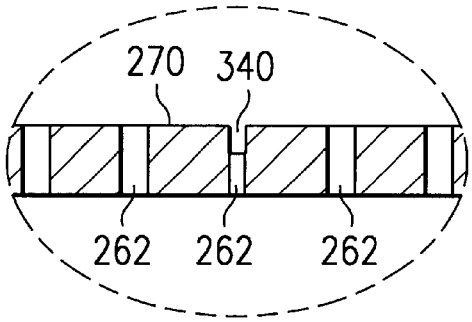
FIGS. 10–10D are diagrams illustrating a folding drum of the transfer station illustrated in FIG. 8 in accordance with an embodiment of the present invention.
Figure 10D:
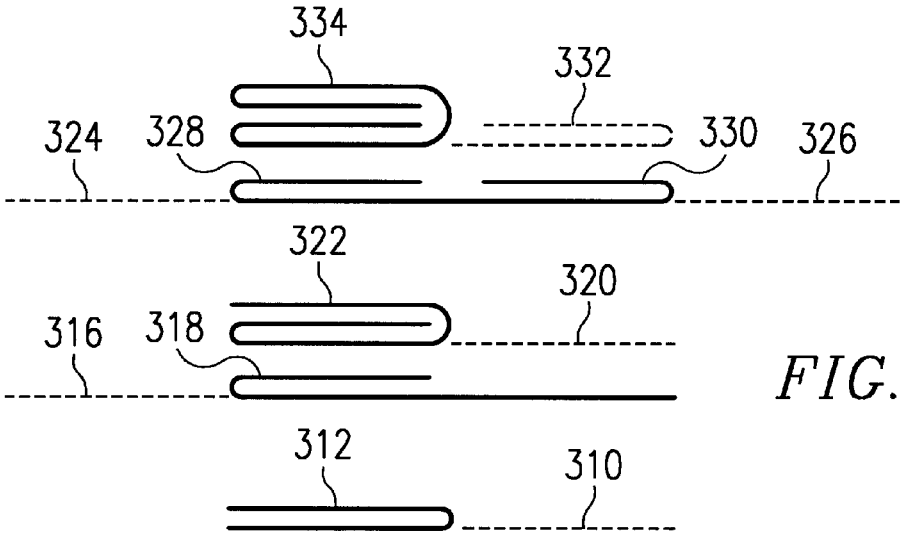

Referring to FIGS. 10A and 10C, drum cover 270 also comprises creasing grooves 336, 338, and 340 to provide easier longitudinal folding of web segment 86 and 240. For example, creasing rollers 244 may be laterally disposed relative to drum cover 270 corresponding to locations of creasing grooves 336, 338, and 340 such that creasing rollers 244 crease web segments 86 and 240 as drum cover 270 rotates. Additionally, creasing rollers 244 may be positioned to crease web segments 86 and 240 while vacuum communication is connected to chambers 288, 290, 292, and 294, as illustrated in FIG. 10B. Thus, air streams from air nozzles 308, 314, and 315 longitudinally fold web segments 86 and 240 along the creases formed by creasing rollers 244. As illustrated in FIG. 10A, drum cover 270 also comprises a circumferentially disposed recess 342 for receiving and retaining stripper belt 246.

Thus, system 10 provides greater flexibility and efficiency than prior systems by providing a variety of folding techniques in a relatively compact area. For example, rotary folder 96 and folding drum 224 may be used to form multiple transverse and longitudinal folds in web segments 86 and 240 in a relatively short downstream traveling distance. FIGS. 11A–11D are diagrams illustrating various folding configurations of web segments using system 10. For example, referring to FIG. 11A, a web segment 350 having a width 352 is fed downstream through system 10 in the direction indicated by arrow 354. Longitudinal folds 356 and 358 may be formed on web segment 350 at folding station 54 using folding plows and rollers 66. Transverse folds 360, 362, and 364 may be formed on web segment 350 at folding station 60 using rotary folder 96. Additionally, longitudinal fold 366 may be formed on web segment 350 at transfer station 62 using folding drum 242.

Figures 11A, 11B, 11C, 11D:
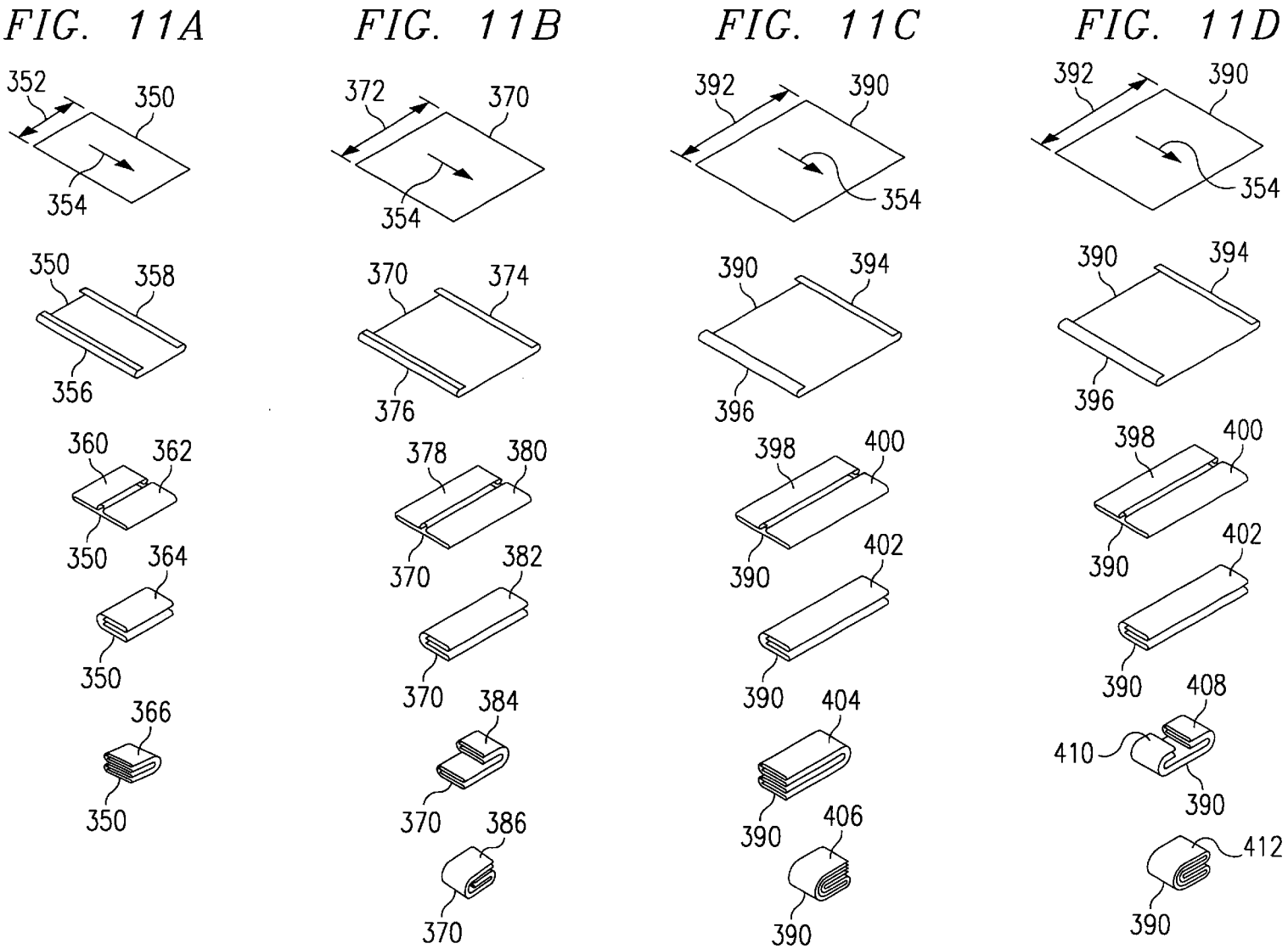
FIGS. 11A–11D are diagrams illustrating folding operations of the system in accordance with an embodiment of the present invention.

Referring to FIG. 11B, a web segment 370 having a width 372 travels downstream through system 10 in the direction indicated by arrow 354. Longitudinal folds 374 and 376 may be formed on web segment 370 at folding station 54 using folding plows and rollers 66. Transverse folds 378, 380, and 382 may be formed on web segment 370 at folding station 60 using rotary folder 96. Additionally, longitudinal folds 384 and 386 may be formed on web segment 370 at transfer station 62 using folding drum 242.

Referring to FIG. 11C, a web segment 390 having a width 392 travels downstream through system 10 in the direction indicated by arrow 354. Longitudinal folds 394 and 396 may be formed on web segment 390 at folding station 54 using folding plows and rollers 66. Transverse folds 398, 400, and 402 may be formed on web segment 390 at folding station 60 using rotary folder 96. Additionally, longitudinal folds 404 and 406 may be formed on web segment 390 at transfer station 62 using folding drum 242.

Referring to FIG. 11D, web segment 390 having a width 392 travels downstream through system in the direction indicated by arrow 354. Longitudinal folds 394 and 396 and transverse folds 398, 400, and 402 may be formed on web segment 390 as described and illustrated in conjunction with FIG. 11C. Longitudinal folds 408, 410, and 412 may be formed on web segment 390 at transfer station 362 using folding drum 242.

Therefore, as illustrated in FIGS. 11A–11D, system 10 may be used to fold various sizes of fabric into folded articles having the same length and width. For example, each folded article illustrated in FIGS. 11A–11D has substantially equal length and width measurements resulting from folding web segments 350, 370, and 390 having various widths 352, 372, and 392, respectively. Thus, system 10 provides greater flexibility than prior systems by providing a variety of folding options to obtain folded articles of a desired size from various sizes of fabric streams. Additionally, as illustrated in FIGS. 11A–11D, system 10 may be used to produce folded articles such that the edges of the fabric segment used to produce the folded article are disposed internally within the folded article, thereby substantially eliminating the possibility of frayed fabric fibers along the edges of the folded article or exposing fiber ends along the edges of the folded article.

Although the present invention and its advantages have been described in detail, it should be understood that various changes, substitutions, and alterations can be made therein without departing from the spirit and scope of the present invention as defined by the appended claims.

What is claimed is:

1. A system for producing folded articles comprising:

a cutting station operable to segment a fabric web into a continuous stream of individual web segments:

a rotary folder comprising a rotary folder axis and a plurality of folding rollers, each of the folding rollers rotating about the rotary folder axis, the rotary folder axis spaced apart from a rotational axis of each of the respective folding rollers, the rotary folder operable to receive the web segments at a first location and fold the web segments one or more times while rotating from the first location to a second location about the rotary folder axis; and a transfer station operable to receive the folded web segments from the rotary folder at the second location and deliver the folded web segments to a third location.

2. The system of claim 1, wherein the transfer station is further operable to deliver the web segments to the third location at a predetermined spacing to match a packaging registration.

3. The system of claim 2, wherein the transfer station receives the web segments from the second location at a first velocity and accelerates the web segments to a second velocity different than the first velocity to obtain the predetermined spacing.

4. The system of claim 1, further comprising a folding station operable to longitudinally fold the fabric web prior to segmenting the fabric web at the cutting station.

5. The system of claim 1, wherein the plurality of rollers rotates about the axis of the rotary folder and return to the first location to receive another web segment.

6. The system of claim 1, wherein the plurality of rollers comprises a plurality of counter-rotating rollers operable to transversely fold the web segments.

7. The system of claim 1, further comprising a tucking roller operable to guide a portion of the web segments into a nip defined by the plurality of rollers.

8. The system of claim 1, wherein the rotary folder further comprises a pick-up shoe operable to receive and transversely fold the web segments prior to delivering the web segments to the plurality of rollers.

9. The system of claim 1, wherein the rotary folder further comprises a pick-up shoe operable to form a first transverse fold in the web segments, and wherein the plurality of rollers receive the web segments from the pick-up shoe and form a second transverse fold in the web segments.

10. The system of claim 1, wherein the rotary folder is operable to transversely fold the web segments, and wherein the transfer station is further operable to longitudinally fold the web segments.

11. A system for producing folded articles comprising:

a cutting station operable to segment a fabric web into a continuous stream of individual web segments:

a rotary folder comprising a rotary folder axis and a plurality of folding rollers, the folding rollers rotating about the rotary folder axis, the rotary folder axis independent and spaced apart from a rotational axis of each of the respective folding rollers, the folding rollers operable to transversely fold the web segments while rotating from a first location to a second location about the rotary folder axis; and a transfer station operable to receive the folded web segments from the rotary folder at the second location and longitudinally fold the web segments.

12. The system of claim 11, wherein the rotary folder further comprises a pick-up shoe operable to receive the web segments from the cutting station and transversely fold the web segments prior to delivering the web segments to the folding rollers.

13. The system of claim 12, wherein the pick-up shoe is disposed adjacent the folding rollers and rotates with the folding rollers about the rotary folder axis.

14. The system of claim 11, further comprising a tucking roller disposed adjacent the rotary folder operable to guide a portion of the web segment into a nip defined by the folding rollers.

15. The system of claim 11, wherein the transfer station is further operable to deliver the folded web segments at a predetermined spacing to match a packaging registration.

16. The system of claim 11, wherein the plurality of folding rollers comprises a first roller, a second roller, and a third roller, the first and second rollers operable to form a first transverse fold in the web segment, and wherein the first roller is further operable to draw the web segment into a nip defined by the first roller and the third roller to form a second transverse fold in the web segment.

17. The system of claim 11, wherein the transfer station comprises a folding drum operable to longitudinally fold the web segments while rotating from a first position to a second position.

18. A system for producing folded fabric articles comprising:

a plurality of valve blocks coupled to a support each having an annular chamber operable to provide vacuum communication from a vacuum supply;

a drum cover rotatably disposed over the valve blocks, the drum cover having a plurality of vacuum ports, wherein rotation of the drum cover about an axis relative to the valve blocks intermittently disposes the vacuum ports in relation to the chambers to connect and disconnect from vacuum communication to respectively retain and release portion of a web segment; and a folding mechanism disposed adjacent the drum cover and operable to fold the released portion of the web segment as the folding drum rotates about the axis.

19. The system of claim 18, wherein the annular chamber of each of the valve blocks extends a predetermined circumferential length to provide the intermittent vacuum communication.

20. The system of claim 18, wherein rotation of the drum cover is operable to retain and release different longitudinal portions of the web segment, and wherein the folding mechanism is operable to longitudinally fold the released portions of the web segment as the drum cover rotates about the axis.

21. The system of claim 18, further comprising a creasing roller operable to crease the web segment as the drum cover rotates about the axis, and wherein the folding mechanism is further operable to fold the web segment at the crease in the web segment.

22. The system of claim 21, wherein the drum cover comprises a circumferentially disposed creasing groove configured to cooperate with the creasing roller to crease the web segment.

23. The system of claim 18, wherein the plurality of valve blocks comprises:

a first valve block having a first annular chamber extending from a first position to a second position;

a second valve block having a second annular chamber extending from the first position to a third position, the first and second chambers operable to provide vacuum communication from the vacuum supply; and wherein the drum cover retains the web segment as the drum cover rotates from the first position to the second position, and wherein the drum cover releases a portion of the web segment as the drum cover rotates from the second position to the third position.

24. The system of claim 23, wherein the vacuum ports are disposed in relation to the first and second chambers to retain the web segment as the drum cover rotates from the first position to the second position, and wherein the vacuum ports are disconnected from communication with the first chamber to release the portion of the web segment as the drum cover rotates from the second position to the third position.

25. The system of claim 18, wherein the folding mechanism comprises a nozzle operable to provide an air stream to fold the released portion of the web segment.

* * * * *